US008651881B2

(12) United States Patent
Regnier et al.

(10) Patent No.: US 8,651,881 B2
(45) Date of Patent: Feb. 18, 2014

(54) RESONANCE MODIFYING CONNECTOR

(71) Applicant: Molex Incorporated, Lisle, IL (US)

(72) Inventors: Kent E. Regnier, Lombard, IL (US); Patrick R. Casher, North Aurora, IL (US); Jerry A. Long, Elgin, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/973,125

(22) Filed: Aug. 22, 2013

(65) Prior Publication Data

US 2013/0340251 A1 Dec. 26, 2013

Related U.S. Application Data

(62) Division of application No. 13/133,436, filed as application No. PCT/US2009/067333 on Dec. 9, 2009, now Pat. No. 8,540,525.

(60) Provisional application No. 61/122,216, filed on Dec. 12, 2008.

(51) Int. Cl.
*H01R 4/66* (2006.01)

(52) U.S. Cl.
USPC ..... 439/108

(58) Field of Classification Search
USPC ..... 439/626, 79, 680, 76.1, 108, 638, 101; 29/876, 832, 843, 854
See application file for complete search history.

(56) References Cited

U.S. PATENT DOCUMENTS

| | | | |
|---|---|---|---|
| 2,664,552 | A | 12/1953 | Ericsson et al. |
| 2,849,700 | A | 8/1958 | Perkin |
| 2,858,372 | A | 10/1958 | Kaufman |
| 3,115,379 | A | 12/1963 | McKee |
| 3,286,220 | A | 11/1966 | Marley et al. |
| 3,343,120 | A | 9/1967 | Whiting |
| 3,399,372 | A | 8/1968 | Uberbacher |
| 3,482,201 | A | 12/1969 | Schneck |
| 3,538,486 | A | 11/1970 | Shiesinger |
| 3,587,028 | A | 6/1971 | Uberbacher |
| 3,591,834 | A | 7/1971 | Kolias |
| 3,641,475 | A | 2/1972 | Irish et al. |
| 3,663,925 | A | 5/1972 | Proctor |
| 3,669,054 | A | 6/1972 | Desso et al. |
| 3,701,076 | A | 10/1972 | Irish |
| 3,748,633 | A | 7/1973 | Lundergan |
| 3,827,005 | A | 7/1974 | Friend |

(Continued)

FOREIGN PATENT DOCUMENTS

| | | |
|---|---|---|
| EP | 0 273 683 A2 | 7/1988 |
| EP | 0 635 910 B1 | 6/2000 |

(Continued)

OTHER PUBLICATIONS

International Search Report for PCT/US2009/067333.

*Primary Examiner* — Jean F Duverne

(74) *Attorney, Agent, or Firm* — Stephen L. Sheldon

(57) ABSTRACT

A connector assembly is provided that is suitable for modifying the resonant frequency of ground terminals used in conjunction with high data rate signal terminals. Ground terminals may be interconnected with a conductive bridge so as to provide ground terminals with a predetermined maximum effective electrical length. Reducing the effective electrical length of the ground terminal can move the resonance frequencies of the connector outside the operational range of frequencies at which signals will be transmitted.

14 Claims, 41 Drawing Sheets

(56) References Cited

U.S. PATENT DOCUMENTS 3,867,008 A 2/1975 Gartland
4,030,792 A 6/1977 Fuerst
4,076,362 A 2/1978 Ichimura
4,155,059 A 5/1979 Doi
4,157,612 A 6/1979 Rainal
4,159,861 A 7/1979 Anhalt
4,232,924 A 11/1980 Kline et al.
4,260,212 A 4/1981 Ritchie et al.
4,288,139 A 9/1981 Cobaugh et al.
4,383,724 A 5/1983 Verhoeven
4,402,563 A 9/1983 Sinclair
4,407,552 A 10/1983 Watanabe et al.
4,482,937 A 11/1984 Berg
4,523,296 A 6/1985 Healy, Jr.
4,560,222 A 12/1985 Dambach
4,571,014 A 2/1986 Robin et al.
4,664,458 A 5/1987 Worth
4,717,360 A 1/1988 Czaja
4,762,500 A 8/1988 Dola et al.
4,776,803 A 10/1988 Pretchel et al.
4,815,987 A 3/1989 Kawano et al.
4,846,727 A 7/1989 Glover et al.
4,850,887 A 7/1989 Sugawara
4,867,713 A 9/1989 Ozu et al.
4,898,539 A 2/1990 Glover et al.
4,900,271 A 2/1990 Colleran et al.
4,907,990 A 3/1990 Bertho et al.
4,913,664 A 4/1990 Dixon et al.
4,917,616 A 4/1990 Demler, Jr. et al.
4,973,271 A 11/1990 Ishizuka et al.
4,975,066 A 12/1990 Sucheski et al.
4,975,069 A 12/1990 Fedder et al.
4,997,390 A 3/1991 Scholz et al.
5,004,426 A 4/1991 Barnett
5,046,960 A 9/1991 Fedder
5,055,054 A 10/1991 Doutrich
5,065,282 A 11/1991 Polonio
5,066,236 A 11/1991 Broeksteeg
5,077,893 A 1/1992 Mosquera et al.
5,094,623 A 3/1992 Scharf et al.
5,098,311 A 3/1992 Roath et al.
5,127,839 A 7/1992 Korsunsky et al.
5,141,455 A 8/1992 Ponn
5,161,987 A 11/1992 Sinisi
5,163,337 A 11/1992 Herron et al.
5,163,849 A 11/1992 Fogg et al.
5,167,528 A 12/1992 Nishiyama et al.
5,174,770 A 12/1992 Sasaki et al.
5,181,855 A 1/1993 Mosquera et al.
5,228,864 A 7/1993 Fusselman et al.
5,238,414 A 8/1993 Yaegashi et al.
5,254,012 A 10/1993 Wang
5,257,941 A 11/1993 Lwee et al.
5,274,918 A 1/1994 Reed
5,277,624 A 1/1994 Champion et al.
5,286,212 A 2/1994 Broeksteeg
5,288,949 A 2/1994 Crafts
5,302,135 A 4/1994 Lee
5,342,211 A 8/1994 Broeksteeg
5,356,300 A 10/1994 Costello et al.
5,356,301 A 10/1994 Champion et al.
5,357,050 A 10/1994 Baran et al.
5,382,168 A 1/1995 Azuma et al.
5,387,111 A 2/1995 DeSantis et al.
5,395,250 A 3/1995 Englert, Jr. et al.
5,429,520 A 7/1995 Morlion et al.
5,431,578 A 7/1995 Wayne
5,475,922 A 12/1995 Tamura et al.
5,522,727 A 6/1996 Saito et al.
5,558,542 A 9/1996 O'Sullivan et al.
5,575,688 A 11/1996 Crane, Jr.
5,586,908 A 12/1996 Lorrain
5,586,912 A 12/1996 Eslampour et al.
5,586,914 A 12/1996 Foster, Jr. et al.
5,590,463 A 1/1997 Feldman et al.
5,609,502 A 3/1997 Thumma
5,620,340 A 4/1997 Andrews
5,634,821 A 6/1997 Crane, Jr.
5,637,019 A 6/1997 Crane, Jr. et al.
5,672,064 A 9/1997 Provencher et al.
5,697,799 A 12/1997 Consoli et al.
5,713,746 A 2/1998 Olson et al.
5,713,767 A 2/1998 Hanson et al.
5,730,609 A 3/1998 Harwath
5,741,144 A 4/1998 Elco et al.
5,741,161 A 4/1998 Cahaly et al.
5,766,023 A 6/1998 Noschese et al.
5,795,191 A 8/1998 Preputnick et al.
5,817,973 A 10/1998 Elco et al.
5,820,392 A 10/1998 Lin et al.
5,833,475 A 11/1998 Mitra
5,853,797 A 12/1998 Fuchs et al.
5,860,816 A 1/1999 Provencher et al.
5,871,362 A 2/1999 Campbell et al.
5,876,222 A 3/1999 Gardner et al.
5,882,227 A 3/1999 Neidich
5,893,761 A 4/1999 Loungeville
5,902,136 A 5/1999 Lemke et al.
5,904,581 A 5/1999 Pope et al.
5,908,333 A 6/1999 Perino et al.
5,938,479 A 8/1999 Paulson et al.
5,961,355 A 10/1999 Morlion et al.
5,967,844 A 10/1999 Doutrich et al.
5,971,817 A 10/1999 Longueville
5,980,321 A 11/1999 Cohen et al.
5,984,690 A 11/1999 Riechelmann et al.
5,992,953 A 11/1999 Rabinovitz
5,993,259 A 11/1999 Stokoe et al.
6,007,376 A 12/1999 Shimizu
6,022,227 A 2/2000 Huang
6,042,427 A 3/2000 Adriaenssens et al.
6,050,862 A 4/2000 Ishii
6,068,520 A 5/2000 Winings et al.
6,086,386 A 7/2000 Fjrlstad et al.
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,139,336 A 10/2000 Olson
6,146,157 A 11/2000 Lenoir et al.
6,146,202 A 11/2000 Ramey et al.
6,146,203 A 11/2000 Elco et al.
6,152,747 A 11/2000 McNamara
6,154,742 A 11/2000 Herriot
6,171,115 B1 1/2001 Mickievicz et al.
6,171,149 B1 1/2001 Van Zanten
6,179,663 B1 1/2001 Bradley et al.
6,190,213 B1 2/2001 Reichart et al.
6,212,755 B1 4/2001 Shimada et al.
6,215,076 B1 4/2001 Inagawa et al.
6,219,913 B1 4/2001 Uchiyama
6,220,896 B1 4/2001 Bertoncini et al.
6,227,882 B1 5/2001 Ortega et al.
6,241,535 B1 6/2001 Lemke et al.
6,267,604 B1 7/2001 Mickievicz et al.
6,269,539 B1 8/2001 Takahashi et al.
6,280,209 B1 8/2001 Bassler et al.
6,293,827 B1 9/2001 Stokoe
6,299,483 B1 10/2001 Cohen et al.
6,299,484 B2 10/2001 Van Woensel et al.
6,302,711 B1 10/2001 Ito
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,350,134 B1 2/2002 Fogg et al.
6,354,877 B1 3/2002 Shuey et al.
6,358,061 B1 3/2002 Regnier
6,361,366 B1 3/2002 Shuey et al.
6,363,607 B1 4/2002 Chen et al.

(56) References Cited

U.S. PATENT DOCUMENTS 6,364,710 B1 4/2002 Billman et al.
6,371,773 B1 4/2002 Crofoot et al.
6,375,478 B1 4/2002 Kikuchi
6,379,188 B1 4/2002 Cohen et al.
6,386,914 B1 5/2002 Collins et al.
6,390,826 B1 5/2002 Affolter et al.
6,409,543 B1 6/2002 Astbury, Jr. et al.
6,414,248 B1 7/2002 Sundstrom
6,420,778 B1 7/2002 Sinyansky
6,431,914 B1 8/2002 Billman
6,435,914 B1 8/2002 Billman
6,457,983 B1 10/2002 Bassler et al.
6,461,202 B2 10/2002 Kline
6,464,529 B1 10/2002 Jensen et al.
6,471,548 B2 10/2002 Bertoncini et al.
6,482,038 B2 11/2002 Olson
6,485,330 B1 11/2002 Doutrich
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,520,803 B1 2/2003 Dunn
6,526,519 B1 2/2003 Cuthbert
6,527,587 B1 3/2003 Ortega et al.
6,537,086 B1 3/2003 MacMullin
6,537,087 B2 3/2003 McNamara et al.
6,537,111 B2 3/2003 Brammer et al.
6,540,522 B2 4/2003 Sipe
6,540,558 B1 4/2003 Paagman
6,540,559 B1 4/2003 Kemmick et al.
6,547,066 B2 4/2003 Koch
6,551,140 B2 4/2003 Billman et al.
6,554,647 B1 4/2003 Cohen et al.
6,561,849 B2 5/2003 Naito et al.
6,565,388 B1 5/2003 Van Woesel et al.
6,572,409 B2 6/2003 Nitta et al.
6,572,410 B1 6/2003 Volstorf et al.
6,589,071 B1 7/2003 Lias et al.
6,592,381 B2 7/2003 Cohen et al.
6,607,402 B2 8/2003 Cohen et al.
6,623,310 B1 9/2003 Billman et al.
6,633,490 B2 10/2003 Centola et al.
6,638,079 B1 10/2003 Billman et al.
6,641,411 B1 11/2003 Stoddard et al.
6,641,825 B2 11/2003 Scholz et al.
6,648,657 B1 11/2003 Korsunsky et al.
6,652,318 B1 11/2003 Winings et al.
6,659,808 B2 12/2003 Billman et al.
6,672,907 B2 1/2004 Azuma
6,692,272 B2 2/2004 Lemke et al.
6,695,627 B2 2/2004 Ortega et al.
6,717,825 B2 4/2004 Volstorf
6,736,664 B2 5/2004 Ueda et al.
6,746,278 B2 6/2004 Nelson et al.
6,749,439 B1 6/2004 Potter et al.
6,762,067 B1 7/2004 Quinnones et al.
6,764,341 B2 7/2004 Lappoehn
6,776,649 B2 8/2004 Pape et al.
6,786,771 B2 9/2004 Gailus
6,797,215 B2 9/2004 Bonk et al.
6,805,278 B1 10/2004 Olson et al.
6,808,399 B2 10/2004 Rothermel et al.
6,808,420 B2 10/2004 Whiteman et al.
6,824,391 B2 11/2004 Mickievicz et al.
6,835,072 B2 12/2004 Simons et al.
6,843,686 B2 1/2005 Ohnishi et al.
6,843,944 B2 1/2005 Bay et al.
6,851,974 B2 2/2005 Doutrich
6,851,980 B2 2/2005 Nelson et al.
6,869,292 B2 3/2005 Johnescu et al.
6,884,117 B2 4/2005 Korsunsky et al.
6,890,214 B2 5/2005 Brown et al.
6,893,300 B2 5/2005 Zhou et al.
6,893,686 B2 5/2005 Egan
6,899,566 B2 5/2005 Kline et al.
6,902,411 B2 6/2005 Kubo
6,913,490 B2 7/2005 Whiteman et al.
6,918,776 B2 7/2005 Spink, Jr.
6,918,789 B2 7/2005 Lang et al.
6,932,649 B1 8/2005 Rothermel et al.
6,939,173 B1 9/2005 Elco et al.
6,945,796 B2 9/2005 Bassler et al.
6,951,466 B2 10/2005 Sandoval et al.
6,953,351 B2 10/2005 Fromm et al.
6,960,103 B2 11/2005 Tokunaga
6,969,280 B2 11/2005 Chien et al.
6,976,886 B2 12/2005 Winnings et al.
6,979,215 B2 12/2005 Avery et al.
6,994,569 B2 2/2006 Minich et al.
7,001,188 B2 2/2006 Kobayashi
7,021,975 B2 4/2006 Lappohn
7,040,901 B2 5/2006 Benham et al.
7,044,794 B2 5/2006 Consoli et al.
7,090,501 B1 8/2006 Scherer et al.
7,094,102 B2 8/2006 Cohen et al.
7,097,506 B2 8/2006 Nakada
7,101,191 B2 9/2006 Benham
7,108,556 B2 9/2006 Cohen et al.
7,114,964 B2 10/2006 Winings et al.
7,118,391 B2 10/2006 Minich et al.
7,131,870 B2 11/2006 Whiteman, Jr. et al.
7,137,832 B2 11/2006 Mongold et al.
7,139,176 B2 11/2006 Taniguchi et al.
7,153,162 B2 12/2006 Mizumura et al.
7,172,461 B2 2/2007 Davis et al.
7,175,446 B2 2/2007 Bright et al.
7,179,108 B2 2/2007 Goodman et al.
7,186,123 B2 3/2007 Lemke et al.
7,207,807 B2 4/2007 Fogg
7,241,168 B2 7/2007 Sakurai et al.
7,278,856 B2 10/2007 Minich
7,281,950 B2 10/2007 Belopolsky
7,285,018 B2 10/2007 Kenny et al.
7,309,239 B2 12/2007 Shuey et al.
7,310,875 B2 12/2007 Evans
7,331,802 B2 2/2008 Rothermel et al.
7,331,830 B2 2/2008 Minich
7,335,063 B2 2/2008 Cohen et al.
7,371,117 B2 5/2008 Gailus
7,396,259 B2 7/2008 Marshall
7,431,616 B2 10/2008 Minich
7,467,955 B2 12/2008 Raistrick et al.
7,497,736 B2 3/2009 Minich et al.
7,524,209 B2 4/2009 Hull et al.
7,534,142 B2 5/2009 Avery et al.
7,758,385 B2 7/2010 Davis et al.
7,762,843 B2 7/2010 Minich et al.
7,837,504 B2 11/2010 Hull et al.
7,862,347 B2 1/2011 Amleshi et al.
7,972,151 B2 7/2011 He et al.
8,096,832 B2 1/2012 Minich et al.
8,137,127 B2 3/2012 Hunkins et al.
2003/0181077 A1 9/2003 Rothermel et al.
2004/0157477 A1 8/2004 Johnson et al.
2004/0224559 A1* 11/2004 Nelson et al. ..... 439/608
2005/0170700 A1 8/2005 Shuey et al.
2005/0196987 A1 9/2005 Shuey et al.
2005/0227552 A1 10/2005 Yamashita et al.
2006/0003628 A1 1/2006 Long et al.
2006/0073709 A1 4/2006 Reid
2006/0094292 A1 5/2006 Shindo
2006/0189212 A1 8/2006 Avery et al.
2006/0192274 A1 8/2006 Lee et al.
2006/0228912 A1 10/2006 Morlion et al.
2006/0232301 A1 10/2006 Morlion et al.
2008/0026608 A1 1/2008 Sano et al.
2008/0096433 A1 4/2008 Bixler et al.
2008/0233800 A1 9/2008 Cai et al.
2011/0300757 A1* 12/2011 Regnier et al. ..... 439/626

FOREIGN PATENT DOCUMENTS

EP 0 891 016 B1 10/2002
EP 1 148 587 B1 4/2005

(56) References Cited

FOREIGN PATENT DOCUMENTS

| | | | |
|---|---|---|---|
| JP | 06-236788 | | 8/1994 |
| JP | 07-114958 | | 5/1995 |
| JP | 11-185886 | | 7/1999 |
| JP | 2000-003743 | | 1/2000 |
| JP | 2000-003744 | | 1/2000 |
| JP | 2000-003745 | | 1/2000 |
| JP | 2000-003746 | | 1/2000 |
| WO | WO 90/16093 | A1 | 12/1990 |
| WO | WO 01/29931 | A1 | 4/2001 |
| WO | WO 01/39332 | A1 | 5/2001 |
| WO | WO 02/101882 | A2 | 12/2002 |
| WO | WO 2004/030158 | A2 | 4/2004 |
| WO | WO 2006/031296 | A2 | 3/2006 |
| WO | WO 2006/105535 | A1 | 10/2006 |
| WO | WO 2009/111283 | A2 | 9/2009 |

* cited by examiner

RESONANCE MODIFYING CONNECTOR

RELATED APPLICATIONS

This application is a divisional application of U.S. Ser. No. 13/133,436, filed Aug. 26, 2011, now U.S. Pat. No. TBD, which in turn is a national phase of PCT Application No. PCT/US09/67333, filed Dec. 9, 2009, which in turn claims priority to U.S. Provisional Appln. Ser. No. 61/122,216, filed Dec. 12, 2008, all of which are incorporated herein by reference in their entirety.

FIELD OF INVENTION

The present invention generally relates to connectors suitable for high data rate communications and, more particularly, to a connector with improved resonance characteristics.

BACKGROUND OF THE INVENTION

While a number of different configurations exist for high data rate connectors, one common configuration is to align a number of terminals in a row so that each terminal is parallel to an adjacent terminal. It is also common for such terminals to be closely spaced together, such as at a 0.8 mm pitch. Thus, high data rate connectors tend to include a number of tightly spaced and similarly aligned terminals.

High data rate communication channels tend to use one of two methods, differential signals or single-ended signals. In general, differential signals have a greater resistance to interference and therefore tend to be more useful at higher frequencies. Therefore, high data rate connectors (e.g., high-frequency capable connectors) such as small form factor pluggable (SFP) style connectors tend to use a differential signal configuration. An increasingly significant issue is that as the frequency of the signals increases (so as to increase the effective data rates), the size of the connector has a greater influence on the performance of the connector. In particular, the electrical length of the terminals in the connector may be such that a resonance condition can occur within the connector if the electrical length of the terminals and the wavelengths of the signals become comparable. Thus, even connector systems configured to use differential signal pairs may experience degradation of performance as operating frequencies increase. Potential resonance conditions in existing connectors tend to make them unsuitable for use in higher speed applications. Accordingly, improvements in the function, design and construction of a high data rate connector assembly is desirable.

SUMMARY OF THE INVENTION

A connector includes a housing that supports a plurality of ground and signal terminals. The terminals can have contact portions, tail portions and body portions extending between the contact and tail portions. The terminals can be positioned in wafers. The signal terminals can be provided as a pair of signal terminals in adjacent wafers that are used as a differential signal pair. A bridge is extends between two adjacent ground terminals while extending transversely and not in contact with signal terminals positioned between the ground terminals. If desired, multiple bridges may be used. In one embodiment, the bridge can be a pin that is inserted through multiple wafers and may extend transversely past a plurality of pairs of differential signal pairs. In another embodiment, the bridge can be a series of clips that are positioned in the wafers so as to allow each clip to engage a clip in an adjacent wafer. If the bridge is a pin, the pin can be inserted through a first side of the connector, pass through multiple wafers and extends to a second side of the connector. While a single bridge can couple three or more ground terminals, in an embodiment a first bridge can be used to couple a first pair of ground terminals and a second bridge can be used to couple a second pair of ground terminals, even if the first and second pair of ground terminals share a terminal. The ground terminals can include translatable arms that are deflected when the bridge engages the ground terminals.

The connector may include a light pipe structure that is supported by the housing. The connector may include a first opening having ground members and signal terminals adjacent thereto so at provide a first mating plane. The connector may include a second opening having ground members and signal terminals adjacent thereto so as to provide a second mating plane. The housing may be configured to be mounted on a circuit board with the upper surface of the circuit board forming a plane and the plane of the circuit board lying between the first and second mating plane. Alternatively, the connector may be configured so that both mating planes are on the same side of the supporting circuit board.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, wherein.

DETAILED DESCRIPTION OF THE ILLUSTRATED EMBODIMENTS

Figure 1:
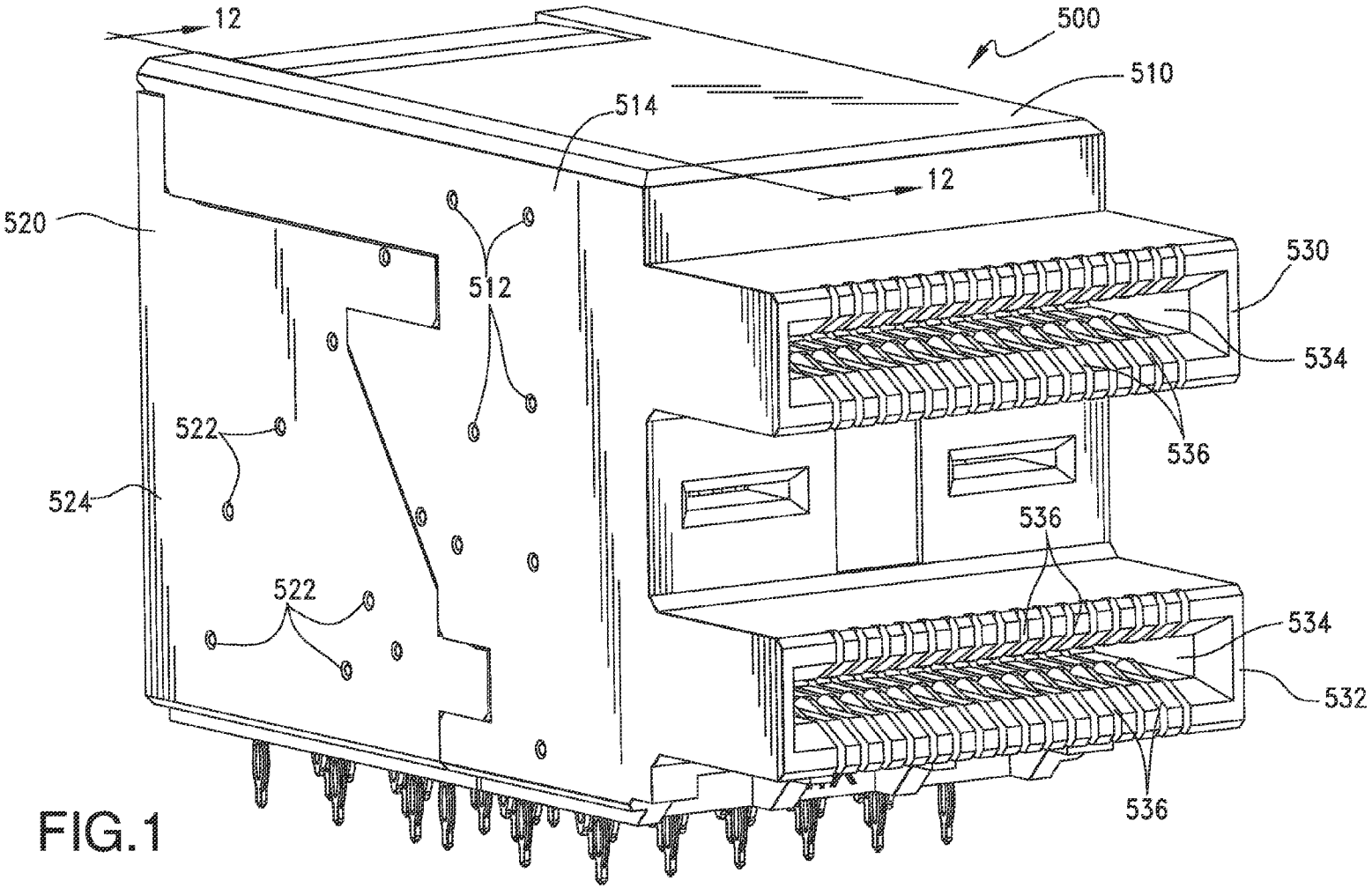
FIG. 1. is a front perspective view of an embodiment of an electrical connector.
Figure 2:
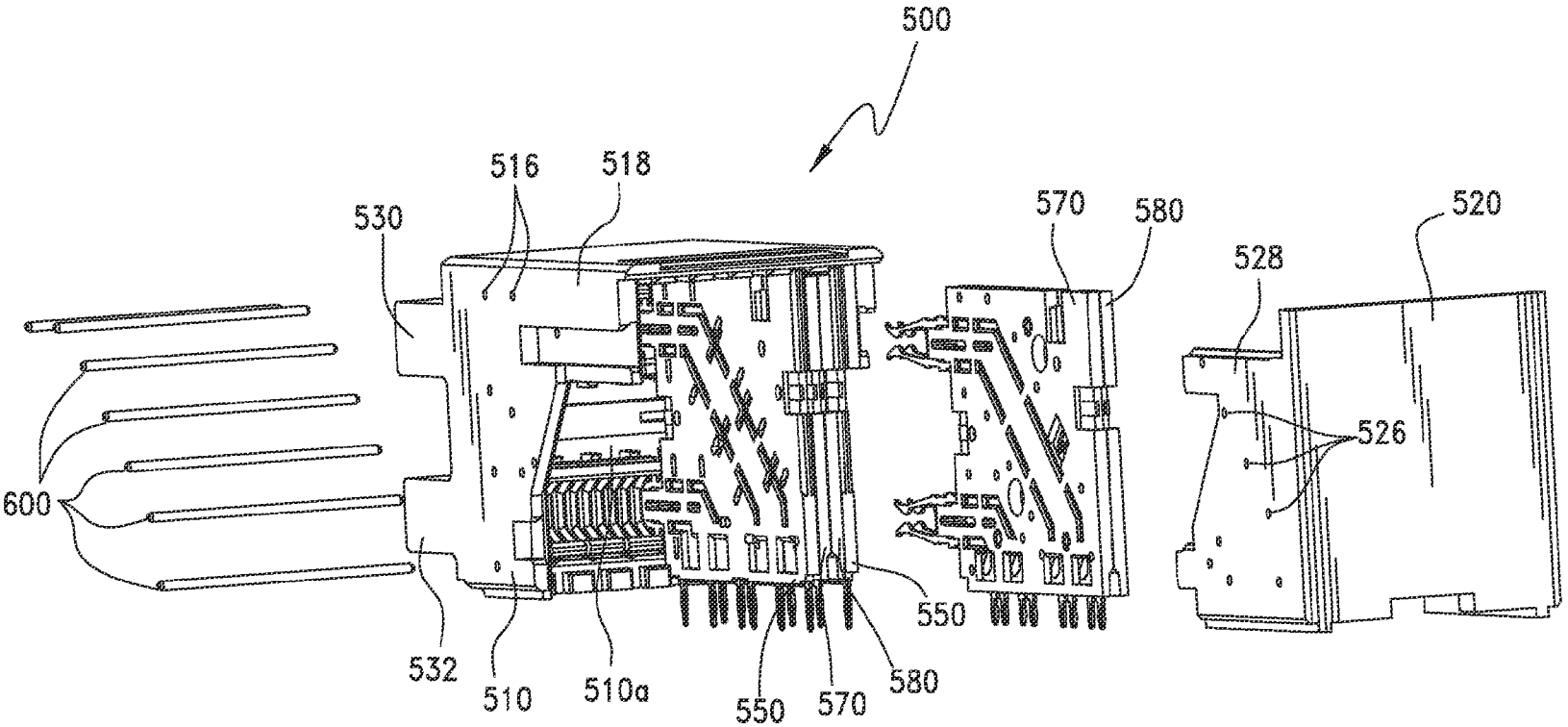
FIG. 2 is an exploded perspective of the connector of FIG. 1 with certain components removed for clarity.
Figure 3:
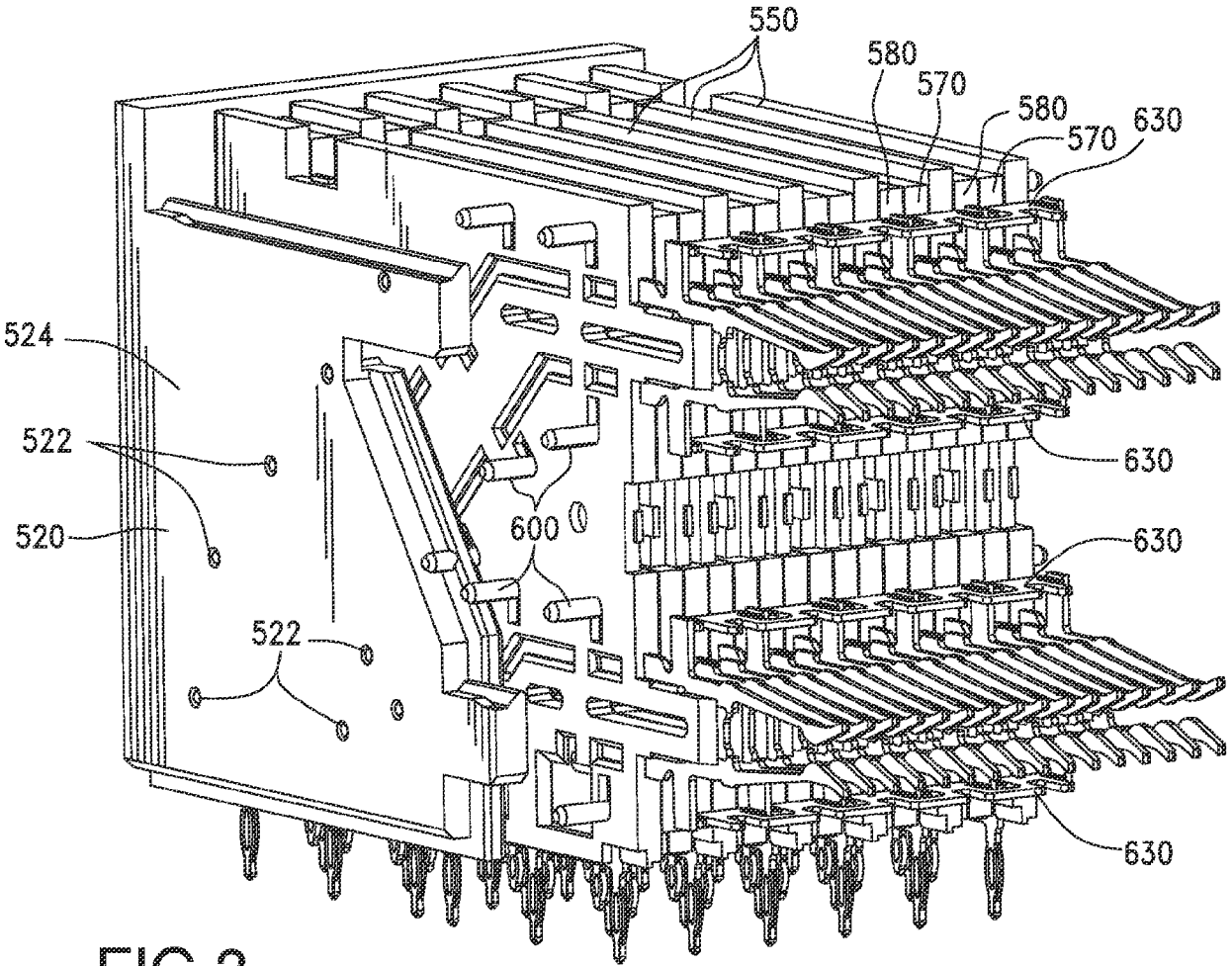
FIG. 3 is a front perspective view of the connector of FIG. 1 with the front housing component removed for clarity.
Figure 4:
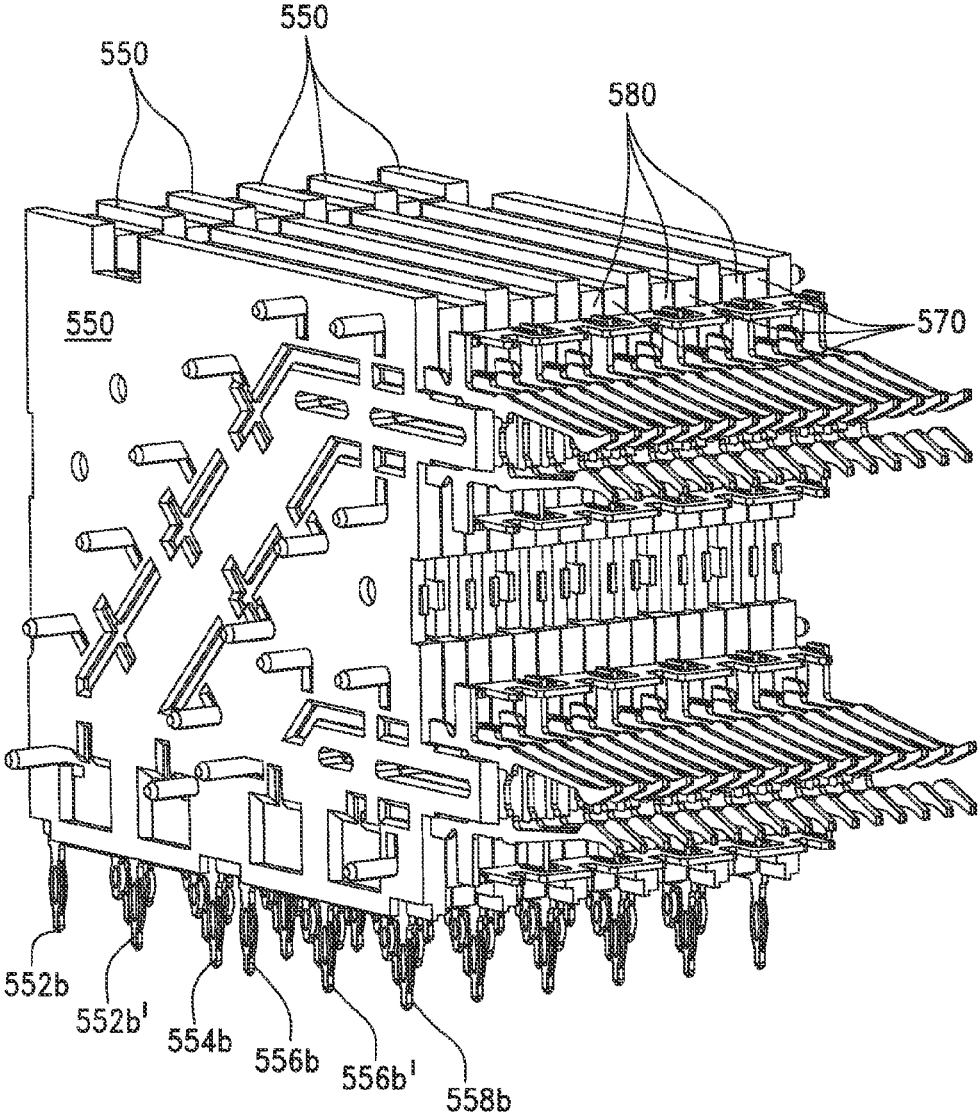
FIG. 4 is a front perspective view similar to that of FIG. 1 but with both of the front and rear housing components removed in order to show the subassembly of internal wafers.
Figure 5:
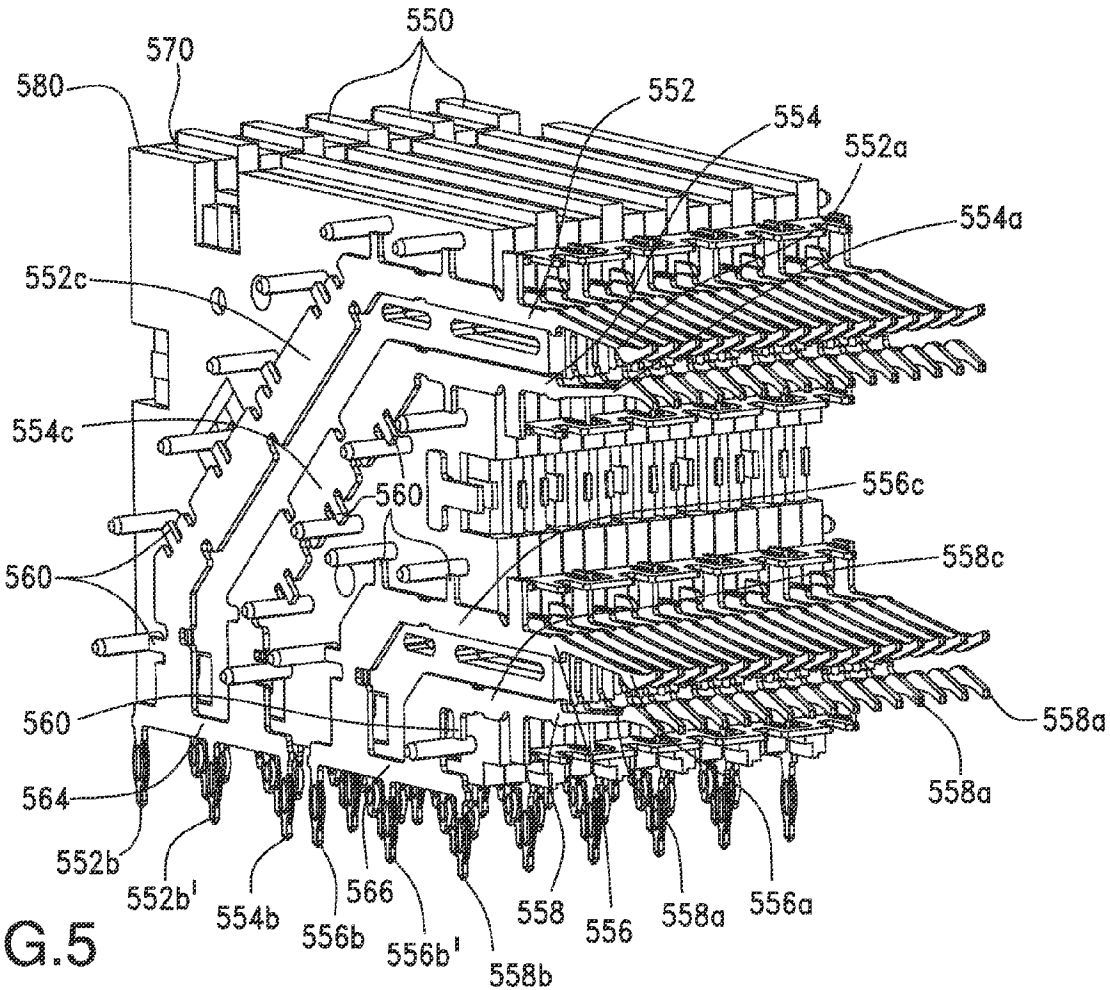
FIG. 5 is a front perspective view similar to FIG. 4 but with the insulation from around one of the ground wafers removed for clarity.
Figure 6:
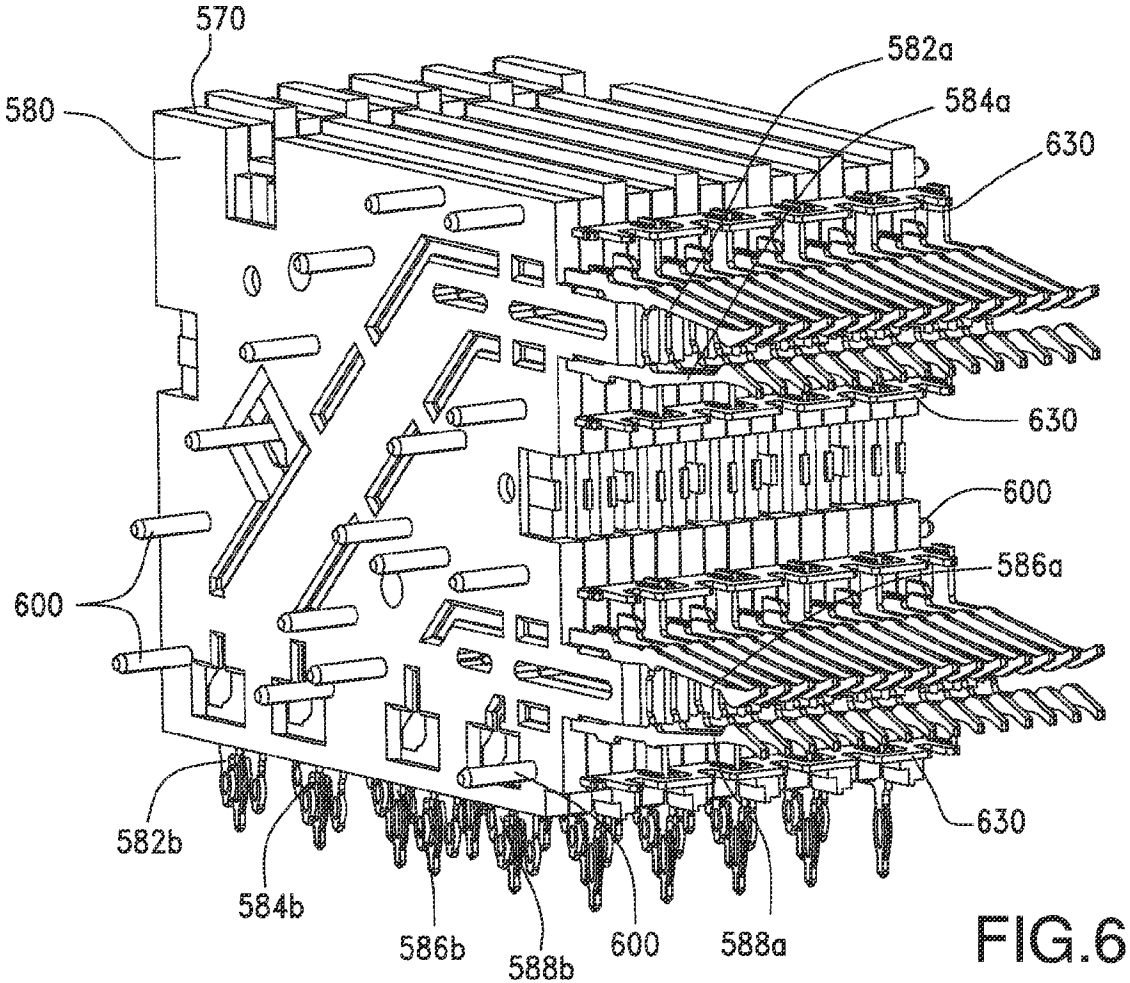
FIG. 6 is a front perspective view similar to that of FIG. 4 but with the endmost ground wafer removed for clarity.
Figure 7:
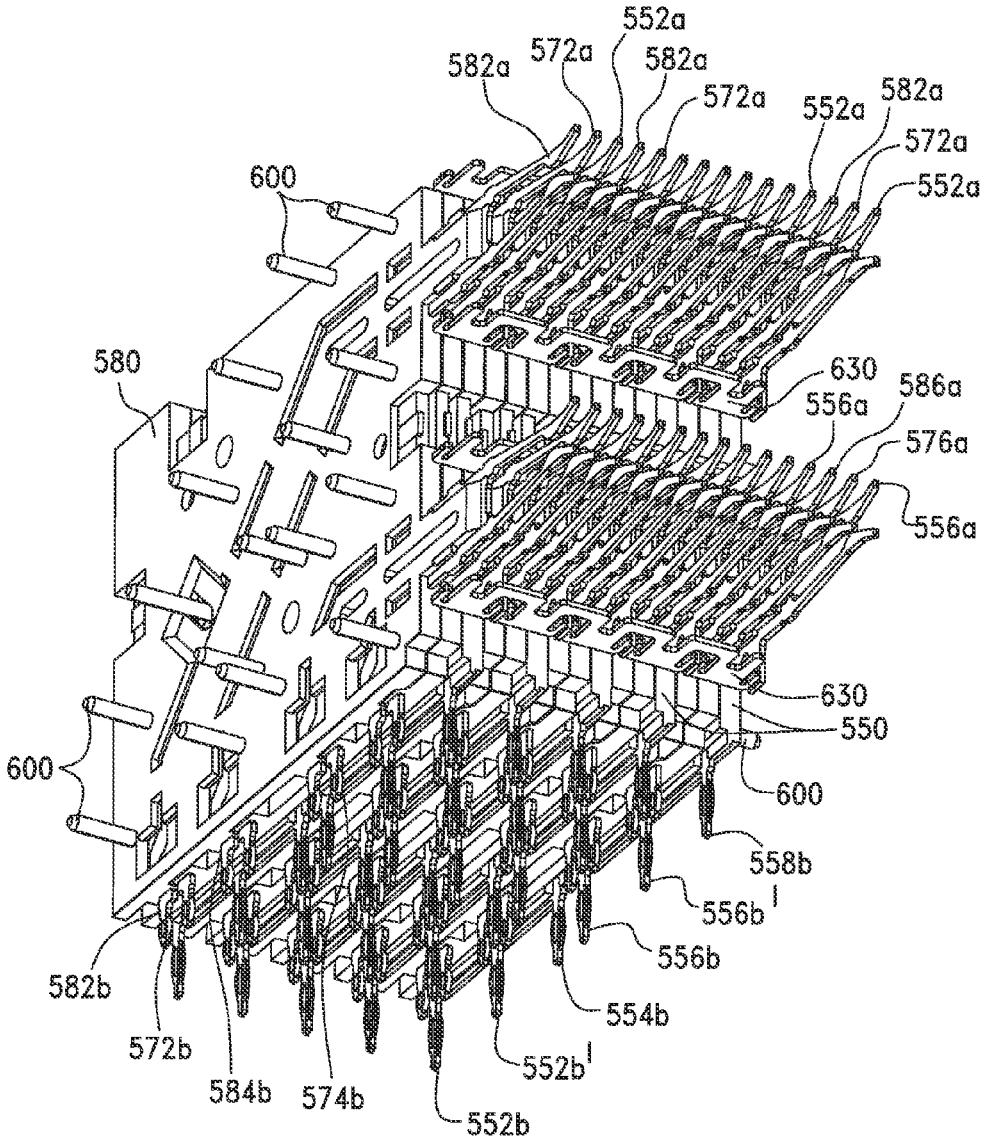
FIG. 7 is a perspective view similar to FIG. 6 but taken from an orientation somewhat beneath the wafer subassembly.
Figure 8:
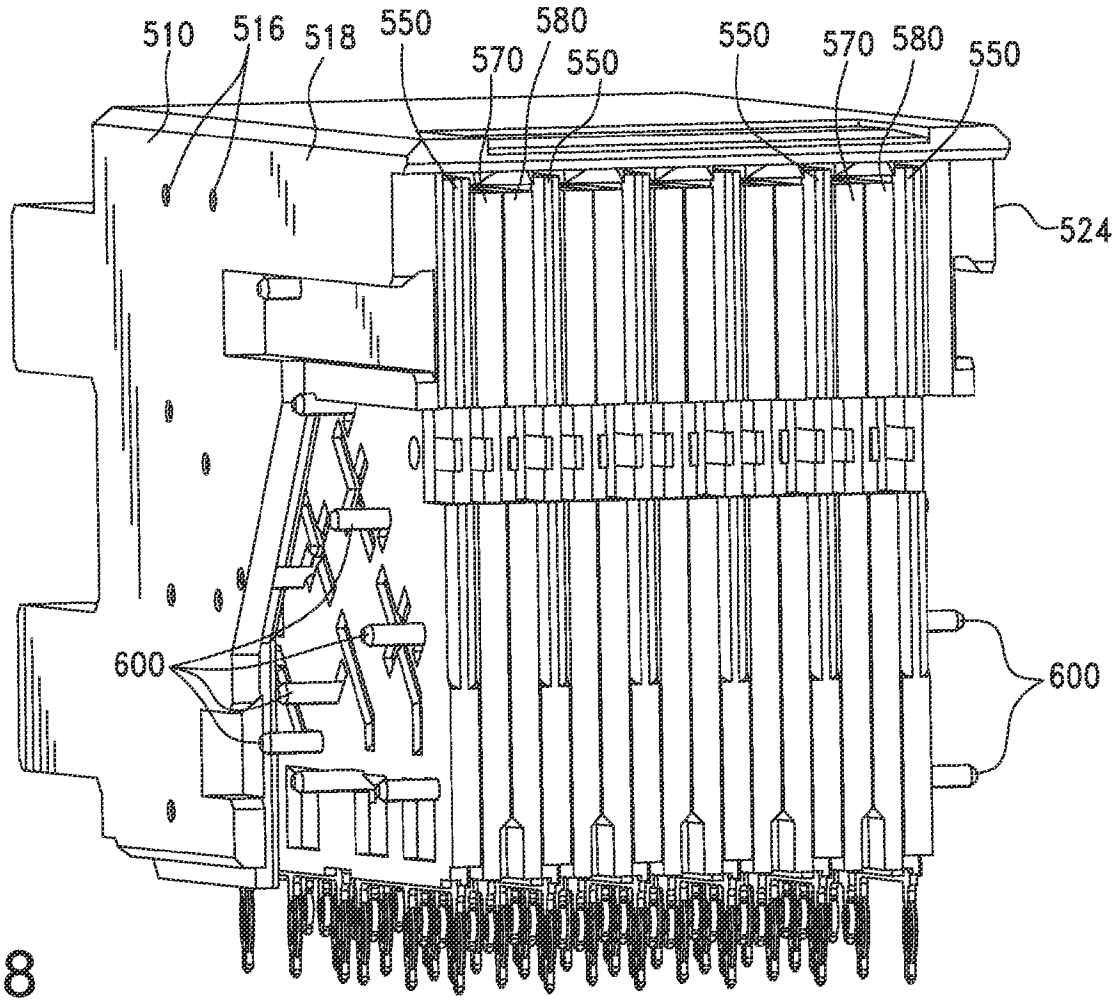
FIG. 8 is a rear perspective view of the connector of FIG. 1 with the rear housing component removed.

As required, detailed embodiments are disclosed herein; however, it is to be understood that the disclosed embodiments are merely exemplary and the depicted features may be embodied in various forms. Therefore, specific details disclosed herein are not to be interpreted as limiting, but merely as a basis for the claims and as a representative basis for teaching one skilled in the art to variously employ the disclosed features in virtually any appropriate manner, including employing various features disclosed herein in combinations that might not be explicitly described.

Small form pluggable (SFP) style connectors are often used in systems where an input/output (I/O) data communication channel is desired. A number of variations in SFP-style connectors exist and different connectors are configured to meet different specifications, such as specifications commonly known as SFP, XFP, QSFP, SFP+ and the like. In general, the SFP-style connectors are configured to mate to modules or assemblies having circuit cards therein and include terminals that, at one end, removably mate with pads on the circuit card and, at an opposite end, extend to traces of a circuit board on which the SFP-style connector is mounted. The details discussed herein, which are based on embodiments of a connector suitable for use with such an SFP-style connector, are not so limited but instead are also broadly applicable to other connector types and configurations as well. For example, without limitation, features of the disclosure may be used for vertical and angled connectors as well as the depicted horizontal connector. In other words, other terminal and housing configurations, unless otherwise noted, may also be used.

In an electrical connector, adjacent terminals, when used to form a high data rate differential pair, electrically couple together to form what can be called a first, or intentional, mode. This mode is used to transmit signals along the terminals that make up the differential pair. However, if other signal terminals are also nearby this differential signal pair, it is possible that one (or both) of the terminals in the differential pair may also electrically couple to one or more of the other terminals (thus forming additional modes). These additional modes are typically undesirable as they can introduce cross-talk that acts as noise relative to the first mode. To prevent such cross-talk, therefore, it is known to shield the differential pair from other signals.

Due to the above-noted tendency to have the terminals located relatively close to each other, pairs of differential signal terminals are often separated from adjacent pairs of differential signal terminals by a ground terminal or a shield. For example, a repeating ground-signal-signal pattern may be used which results in a differential signal pair being surrounded by a ground on each side when the pattern is aligned in a row (e.g., G, $S^+$, $S^-$, G). A potential issue that arises due to the use of ground terminals as shields is that another mode is created by the coupling between each ground terminal and the pairs of signal terminals. In addition, the difference in voltage between two different grounds can also cause the grounds to couple together as transient signals pass through the connector. These various couplings create additional modes (and resultant electromagnetic fields) and introduce noise from which the first mode must be distinguished if the communication system is going to operate effectively.

The additional modes generally do not cause problems at low data rates as such additional modes tend to operate at higher frequencies and have less power compared to the first mode and thus do not cause a serious noise issue, assuming the connector is otherwise properly designed. However, as the frequency of the data transmission increases, the wavelength of the signal moves closer to the electrical length of the ground terminals. Therefore, at higher frequencies, it is possible that the transmission frequency will be high enough, and thus the wavelength short enough, to create undesirable resonance in the connector. Such resonance can amplify the secondary modes, which are typically noise, sufficiently to raise the amplitude of the noise as compared to the amplitude of the signal so that it becomes difficult to distinguish between signals and noise. Accordingly, it is desirable for the operating range of a connector to be sufficiently below the resonant frequency of the connector.

As used herein, the term resonant frequency refers to the lowest resonant frequency or fundamental frequency of the connector. Additional resonant frequencies, known as harmonics, exist above the lowest resonant frequency but may generally be ignored since a connector operating within a range below the lowest resonant frequency will also be operating below the harmonics and a connector operating within a range that includes the lowest resonant frequency will likely have issues with respect to noise (absent other steps taken to eliminate or reduce the noise) regardless of whether the operating range also overlaps with any of the harmonics.

The resonant frequency of a connector is a function of the longest effective electrical length between discontinuities or significant changes in impedance along the electrical path which includes the ground terminals. In other words, the resonant frequency depends on the effective electrical length between the points at which two adjacent ground paths are electrically connected. A non-limiting example of such a connection is a ground plane within a circuit board or card to which both of the adjacent ground terminals are connected. It should be noted that the effective electrical length is a function of numerous factors including the physical length of the terminal, the physical characteristics of the terminal (such as its geometry and surrounding dielectric material, both of which affect its impedance) and the physical length and characteristics beyond the terminal (such as within a circuit board) prior to reaching the discontinuity or intersection.

As an example, the physical distance between discontinuities of a pair of ground terminals having tails mounted in a circuit board and contact ends mated to conductive pads on a circuit card would be equal to the physical length of a ground terminal (defined as the distance from the point at which the terminals reach a common ground or reference plane within the circuit board on which they are mounted to the contact ends of the terminals at which they engage the conductive pads of the circuit card) plus the physical length from the conductive pads on the circuit card to a common ground plane within the circuit card. To determine the effective electrical length, which is measured in picoseconds, between discontinuities, one would also need to factor in characteristics that affect the impedance of the circuit path including the physical geometry of the conductors as well as the dielectric medium surrounding the paths.

A connector that can minimize resonance in the relevant frequency range of signaling can provide certain advantages. It has been determined that decreasing the effective electrical length of the ground terminals, which effectively decreases the length between discontinuities, can provide significant benefits in this regard. In particular, decreasing the electrical length of the terminal so that it is not more than one half the electrical length associated with a particular frequency (e.g., the electrical length between discontinuities is about one half the electrical length associated with a wavelength at the ⅔ Nyquist frequency) has been determined to significantly improve connector performance. It should be noted, however, that in certain embodiments the actual electrical length of the terminal is not the effective electrical length of the connector because there is an additional distance traveled outside the connector before a discontinuity is encountered. For example, the distance from the edge of the contact of the terminal along a contact pad and though a circuit board until reaching a common ground plane is part of the electrical length between discontinuities. Therefore, a connector with ground terminals that have an electrical length of about 40 picoseconds might, in operation, provide an effective electrical length of about 50 picoseconds between discontinuities once the circuit board and contact pad were taken into account. As can be appreciated, this difference can be significant at higher frequencies as a difference of 10 picoseconds in electrical length could result in a connector suitable for about 20 Gbps performance versus one suitable for about 30 Gbps performance.

As it is often not practicable to shorten or reduce the size of the entire connector, the resonance problem in a differential connector that provides rows of terminals has proven difficult to solve in an economical manner. To address this problem, however, it has been determined that one or a plurality of conductive bridges or commoning members can be used to connect multiple ground terminals so as to shorten the distance between discontinuities, thus reducing the electrical length and raising the resonant frequency. This reduced electrical length permits the establishment of a maximum effective electrical length below a desired level and allows higher frequencies to be transmitted over the connector without encountering resonance within the operating range of the connector. For example, placing a conductive bridge or commoning member so that it couples two ground terminals together at their physical mid-point can reduces the effective electrical length of the ground terminals in the connector approximately in half and therefore raises the resonant frequency by approximately doubling it. In practice, since a bridge has a physical length as it extends between the two ground terminals, placing a bridge at or near the physical midpoint may not reduce the electrical length exactly in half but the reduction can be relatively close to half of the original electrical length.

The features described below thus illustrate embodiment where certain features are used to provide a reduced electrical length. If desired, a connector may be provided having a dielectric housing, a first wafer positioned in the dielectric housing and supporting a first conductive ground terminal and a second wafer positioned in the dielectric housing and supporting a second conductive ground terminal. A pair of signal terminal may be positioned between the first and second ground terminals and at least one conductive bridge may extend between the first ground terminal and the second ground terminal with the conductive bridge electrically connecting the first and second ground terminals and configured so as to provide a reduced maximum effective electrical length of the first and second ground terminals.

If desired, the conductive bridge may be a conductive pin extending through the first and second wafers. Each of the first and second conductive ground terminals may include a contact section at one end for mating with a mating component, a tail at an opposite end for mounting to a circuit member and a generally plate-like body section therebetween. The conductive bridge may be positioned where appropriate and in an embodiment may be positioned so as to electrically connect the first and second ground terminals at a location generally towards a midpoint between the contact ends and the tails of the first and second ground terminals. In one configuration, the reduced maximum effective electrical length of the ground terminals may be less than about 38 picoseconds. In another configuration, the reduced maximum effective electrical length of the ground terminals may be less than about 33 picoseconds. In another configuration, the reduced maximum effective electrical length of the ground terminals may be less than about 26 picoseconds. The conductive bridge may extend transversely past a plurality of pairs of differentially coupled high data rate signal terminals.

If desired, a method of increasing a resonant frequency of an electrical connector above a desired operational frequency range of the connector may be utilized. Such method includes determining the desired operational frequency range of the connector, and providing first and second spaced apart ground members with the first ground member defining at least part of a first electrical path and the second ground member defining at least part of a second electrical path. A differential signal pair can be provided between the first and second ground members and the approximate maximum effective electrical length between discontinuities along the first and second electrical paths is determined. An initial resonant frequency is determined based on the approximate longest effective length between the discontinuities along the first and second electrical paths and a maximum desired effective electrical length between the discontinuities is determined in order to increase the resonant frequency of the electrical connector above the desired operational frequency range. At least one conductive bridge is connected between the first and second ground terminals to reduce the effective electrical length between discontinuities along the first and second ground members to a length that is less than the maximum desired effective electrical length.

If desired, determining the maximum effective electrical length between discontinuities along the first and second electrical paths may include simulating an electrical system. The simulating step may include analyzing physical characteristics of the ground members including their length, geometry and the dielectric medium surrounding the ground members. The simulating step may include analyzing additional circuit components that define at least part of the first and second electrical paths. Determining the maximum effective electrical length between discontinuities along the first and second electrical paths may include testing the electrical connector.

Referring now to the Figures, FIGS. 1-13 illustrate an embodiment of a connector 500 that includes a first housing component 510 and a second housing component 520. The first housing component 510 includes a first projection 530 and a second projection 532, both of which have a card slot 534 configured to receive circuit cards (not shown) that are supported by a corresponding mating module (not shown). As depicted, each card slot 534 includes terminal receiving grooves 536 extending along the top and bottom inner surfaces thereof.

Pin receiving apertures 512 may be provided in a first side 514 of first housing component 510 and pin receiving apertures 516 aligned with pin receiving apertures 512 may be provided in a second side 518 of first housing component 510. Similarly, pin receiving apertures 522 may be provided in a first side 524 of second housing component 520 and pin receiving apertures 526 aligned with pin receiving apertures 522 may be provided in a second side 528 of second housing component 520. Depending upon the assembly process used, apertures may not be necessary on both sides of first housing component 510 nor on both sides of housing component 520. In certain instances, apertures in the first and second housing components may not be necessary at all.

As depicted, the front housing component 510 includes a cavity 540 into which a plurality of insert-molded terminal wafers 550, 570, 580 may be inserted. As depicted, each wafer includes two pairs of conductive terminals with a plastic insulative body insert-molded around the terminals. Each terminal has a contact end for mating with a pad (not shown) on a mating circuit card, at least one tail for engaging a plated hole in a circuit board on which connector 500 is mounted, and a body connecting the contact end and the at least one tail.

More particularly, referring to FIGS. 5, 9, 10, 12, ground wafer 550 includes four ground terminals 552, 554, 556, 558, each having a mating end 552*a*, 554*a*, 556*a*, 558*a* depicted as a deflectable contact beam or spring arm at one end for engaging a mating component (not shown) and tails 552*b*, 552*b*', 554*b*, 556*b*, 556*b*', 558*b* depicted as compliant pins for engaging a circuit member (not shown) on which connector 500 is mounted. Relatively large or wide body sections 552*c*, 554*c*, 556*c*, 558*c* extend between mating ends 552*a*, 554*a*, 556*a*, 558*a* and tails 552*b*, 554*b*, 556*b*, 558*b*, respectively, of each terminal. In addition, each ground terminal 552, 554, 556, 558 includes a plurality of deflectable tabs or fingers 560 extending therefrom and a single, relatively wide tab 562 generally adjacent mating end 552*a*, 554*a*, 556*a*, 558*a*. If desired, fingers 560 may be slightly angled towards one of the sides of housing components 510, 520. A first joining member 564 may be provided between the longer two ground terminals 552, 554, and second joining member 566 may be provided between the shorter two ground terminals 556, 558.

Figure 16:
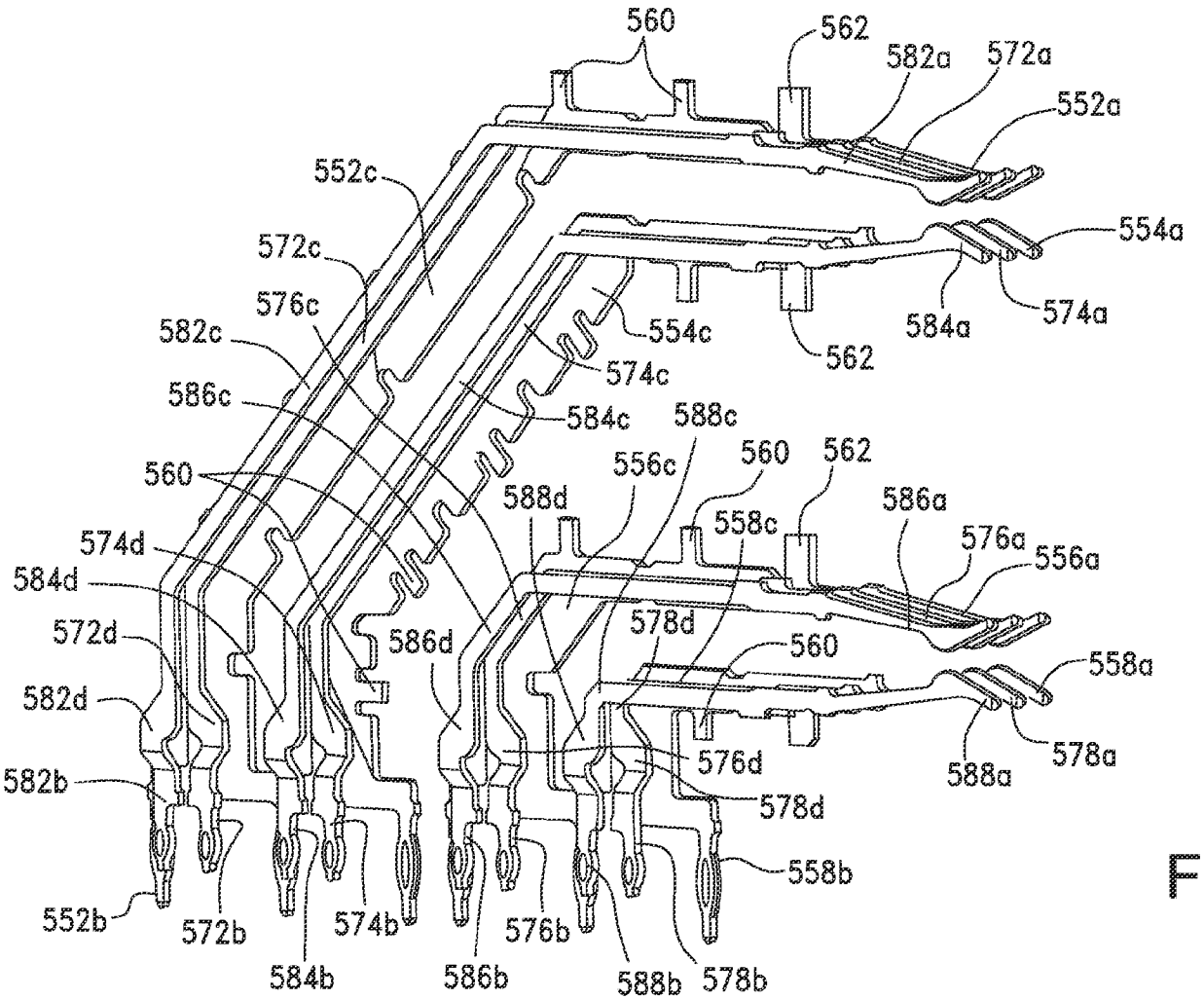
FIG. 16 is a perspective view of four pairs of signal terminals and one ground terminal associated with each row of signal terminals.
Figure 17:
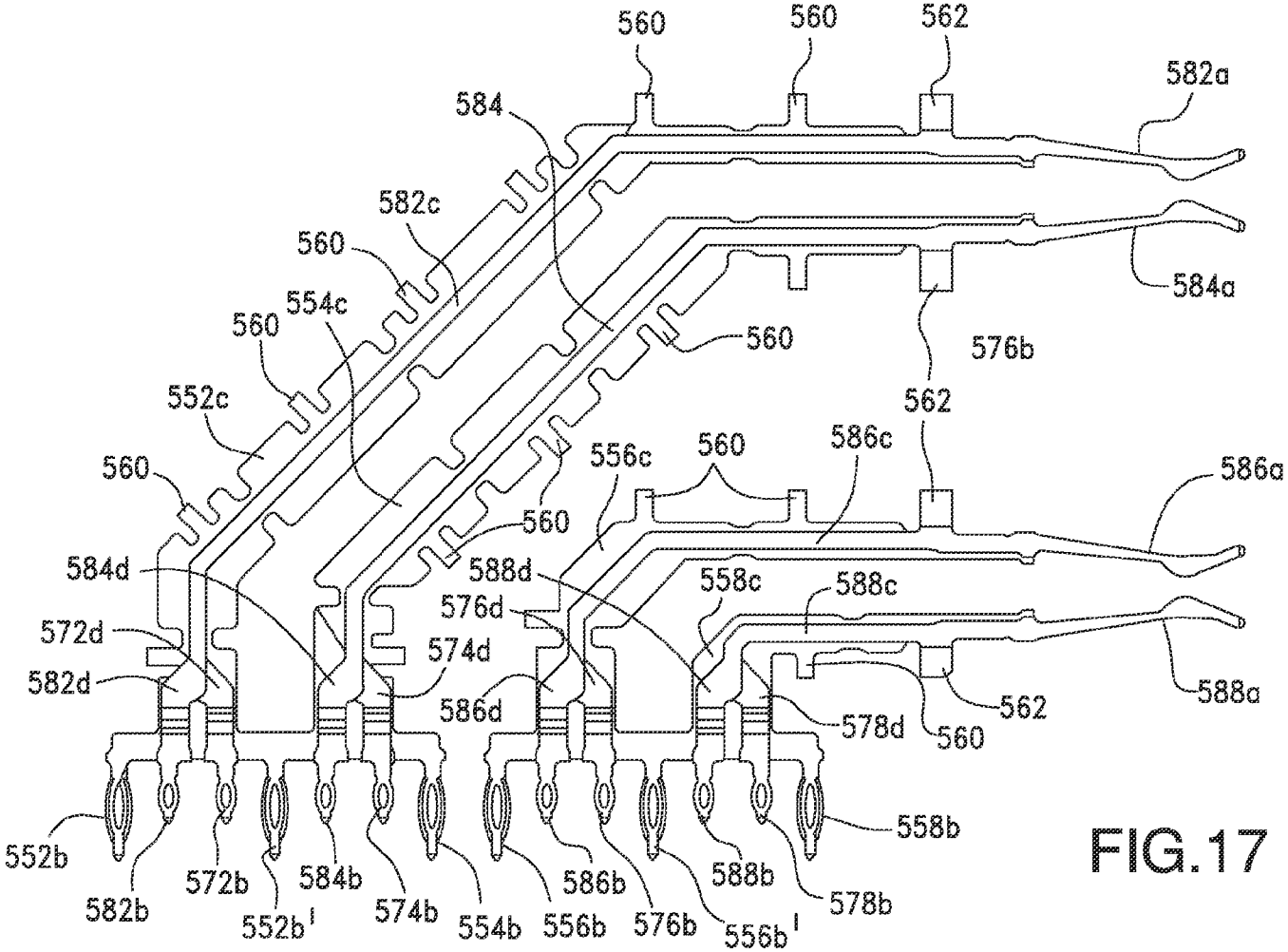
FIG. 17 is a side elevational view of the terminals of FIG. 16 showing the relative widths of the body sections of the signal terminals compared to those of the ground terminals.
Figure 18:
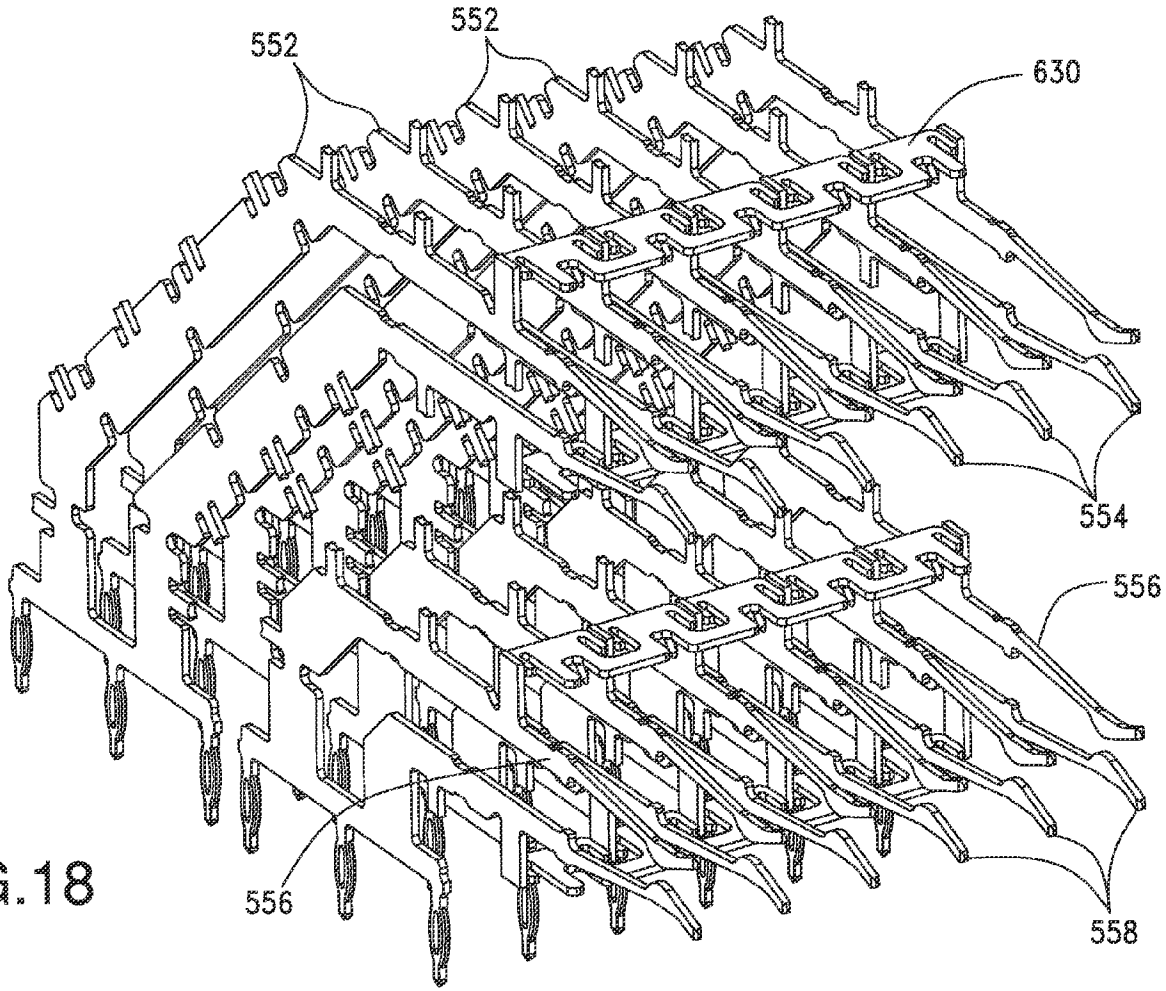
FIG. 18 is a perspective view similar to FIG. 9 but showing only the ground terminals and the front bridging structure.
Figure 18A:
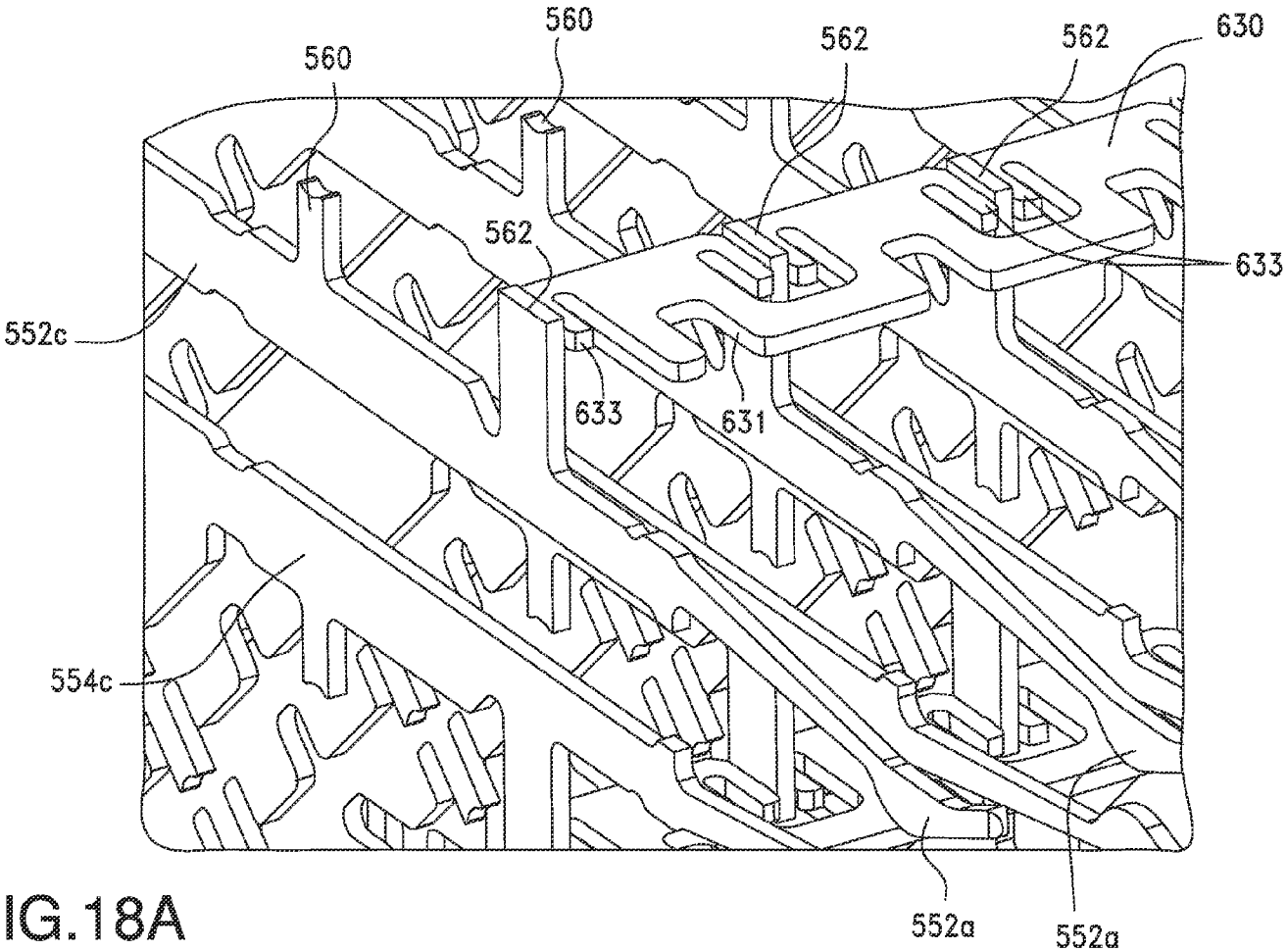
FIG. 18A is an enlarged perspective view of a portion of FIG. 18 showing the interaction between the ground terminals and the front bridging structure.

Signal wafers 570, 580 can be configured in a substantially similar manner with respect to each other and can be somewhat similar to ground wafers 550. As depicted in FIGS. 16, 17, each first signal wafer 570 has four signal terminals 572, 574, 576, 578 with a mating end 572*a*, 574*a*, 576*a*, 578*a* depicted as a deflectable contact beam or spring arm at one end for engaging a mating component (not shown) and a tail 572*b*, 574*b*, 576*b*, 578*b* depicted as a compliant pin for engaging a circuit member (not shown) on which connector 500 is mounted. Relatively small or narrow body sections 572*c*, 574*c*, 576*c*, 578*c* extend between mating ends 572*a*, 574*a*, 576*a*, 578*a* and tails 572*b*, 574*b*, 576*b*, 578*b*, respectively, of each terminal. The difference in width between body sections 572*c*, 574*c*, 576*c*, 578*c* of ground terminals 552, 554, 556, 558 and body sections 572*c*, 574*c*, 576*c*, 578*c* of signal terminals 572, 574, 576, 578 is best seen in FIG. 17. Signal terminals 572, 574, 576, 578 further include transition sections 572*d*, 574*d*, 576*d*, 578*d* between body sections 572*c*, 574*c*, 576*c*, 578*c* and tails 572*b*, 574*b*, 576*b*, 578*b* in order to offset the tails from the body sections.

Second signal wafer 580 includes four signal terminals 582, 584, 586, 588 that, except as noted below, are substantially identical to the signal terminals 572, 574, 576, 578 of the first signal wafer 570 and the description of which is not repeated herein. However, as can be appreciated from FIG. 11, the tails 572*b*, 574*b*, 576*b*, 578*b* of first wafer 570 and the tails 582*b*, 584*b*, 586*b*, 588*b* of second wafer 580 are offset from the plane of their respective body sections in opposite directions towards the other wafer so that the tails of the signal terminals of both wafers are aligned in a single row. Upon insertion of the wafers 550, 570, 580 into the housing cavity 510*a*, the contact sections of the terminals are positioned in and may be supported by the terminal receiving grooves 536 so as to form a row of contact ends. In operation, the row of contact sections facilitates mating between the connector and pads on circuit cards which may be inserted into card slots 534.

As depicted, the wafers are positioned within cavity 510*a* in a repeating pattern with two signal wafers 570, 580 positioned next to each other to create pairs of horizontally aligned differential-coupled signal terminals. The depicted terminals are broadside-coupled, which has the benefit of provide a stronger coupling between the terminals that form the differential pair, but unless otherwise noted, broadside coupling is not required. Ground wafers 550 are positioned on both sides of each pair of signal wafers in order to achieve the desired electrical characteristics of the signal terminals and to create a repeating ground, signal, signal, pattern (e.g., G, $S^+$, $S^-$, G, $S^+$, $S^-$, G). If desired, other patterns of wafers could be utilized such as adding additional ground wafers (e.g., G, $S^+$, $S^-$, G, G, $S^+$, $S^-$, G) to further isolate the signal terminals and/or additional signal wafers could be added in which the addition signal terminals would typically be used for "lower" speed signals (e.g., G, $S^+$, $S^-$, G, S, S, S, G, $S^+$, $S^-$, G). In addition, if desired, rather than molding two separate signal wafers 570, 580 and then position them adjacent to each other during the assembly process, it is also possible that the two signal wafers could be combined so as to provide a single wafer molded around all of the terminals. In addition, if desired, the wafers need not be insert molded. For example, the wafer housing could be molded in a first operation and the terminals inserted into the wafer housing in a second, subsequent operation. Insert molded wafers, however, are beneficial to precisely control the orientation of terminals supported by the wafer.

Figure 9:
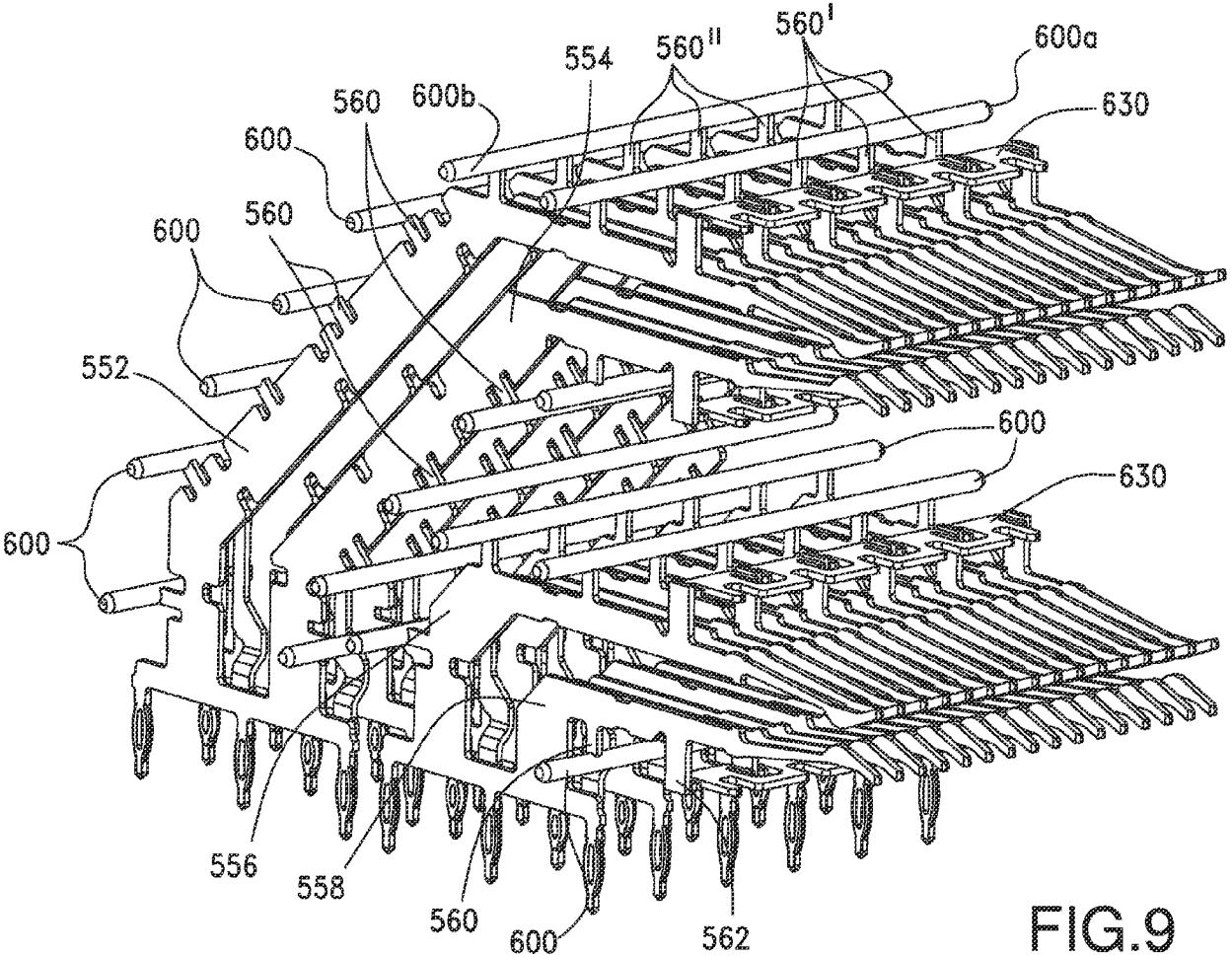
FIG. 9 is a perspective view of the wafer subassembly of FIG. 4 but with all of the insulative components removed for clarity.
Figure 10:
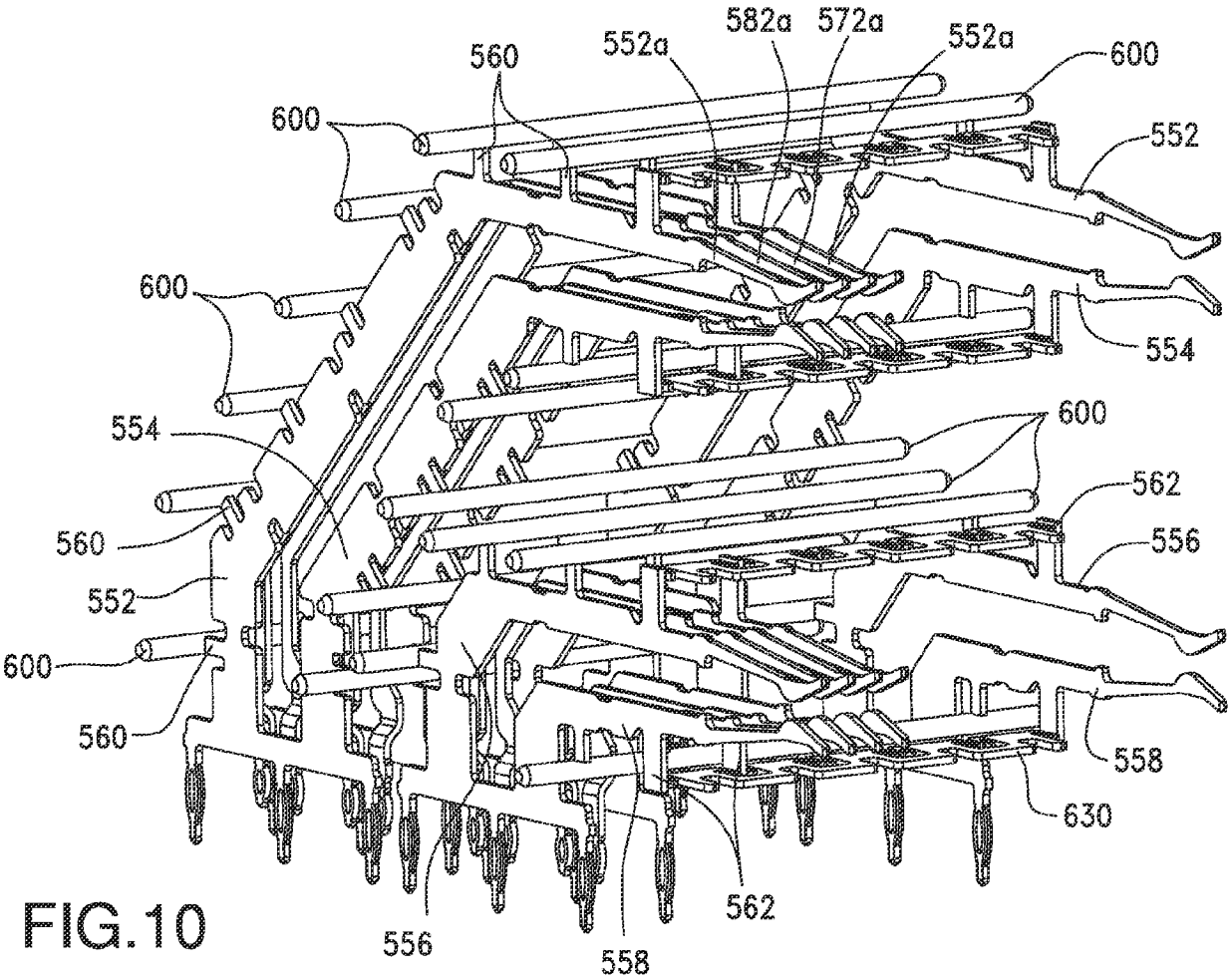
FIG. 10 is a view of the subassembly of FIG. 9 but with some of the terminals removed for clarity.

In order to achieve the desired electrical characteristics, the depicted embodiment illustrates a connector with pins 600 (e.g., the pins providing the electrically conductive bridges) to be inserted once wafers 550, 570, 580 are loaded into the first and second housing components 510, 520. The pins 600 engage and deflect fingers 560 of the ground terminals to couple together multiple ground terminals and thus form electrically conductive bridges. More particularly, as best seen in FIG. 9, a first pin 600*a* engages a first set of aligned fingers 560' of ground terminals 552, a second pin 600*b* engages a second set of aligned fingers 560" of ground terminals 552, and this can be repeated with additional pins so that ground terminals 552 are interconnected or commoned at multiple locations. It should be noted that the fingers 560 may be somewhat deflected out of the plane of the body section of each ground terminal but, for clarity, such deflection is not shown in the drawings.

The bridges (depicted as pins 600 in FIGS. 1-28) couple fingers 560 that extend from the body portions 552*c*, 554*c*, 556*c*, 558*c* of the ground terminals 552, 554, 556, 558. It has been determined that for a multi-row connector design, the height of the connector and the length of the ground terminals make the inclusion of a number of bridges desirable so as to ensure the effective electrical length is short enough. The pins 600 may be formed of a sufficiently conductive material such as a copper alloy with a desirable diameter, such as between 0.4 mm and 0.9 mm. It has been determined that such a construction allows for a pin 600 that has sufficient strength to allow for insertion while avoiding any significant increase in size of the connector. As can be appreciated, a shorter connector may be able to provide ground terminals with a desirable electrical length while only using one bridge. It is expected, however, that a plurality of bridges will be beneficial in many connector configurations.

For connector with multiple rows of contacts, such as those depicted, the terminals have different lengths, depending on the row in which they are positioned. Consequentially, a different number of bridges can be used with each row of ground terminals to ensure the corresponding row of ground terminals has the desired maximum electrical length. For example, in FIG. 4, the top row of ground terminals 552 in the first projection 530 is coupled to seven pins 600 while the opposing row of ground terminals 554 is coupled to five pins 600. The top row of ground terminals 556 in the second projection 532 is coupled to three pins 600 while the opposing row of ground terminals 558 is coupled to one pin 600. Thus, in the depicted embodiment, the number of pins in subsequent lower rows decreases by two as compared to the prior upper row. This helps ensure a desirable performance while minimizing complexity and cost.

Figure 11:
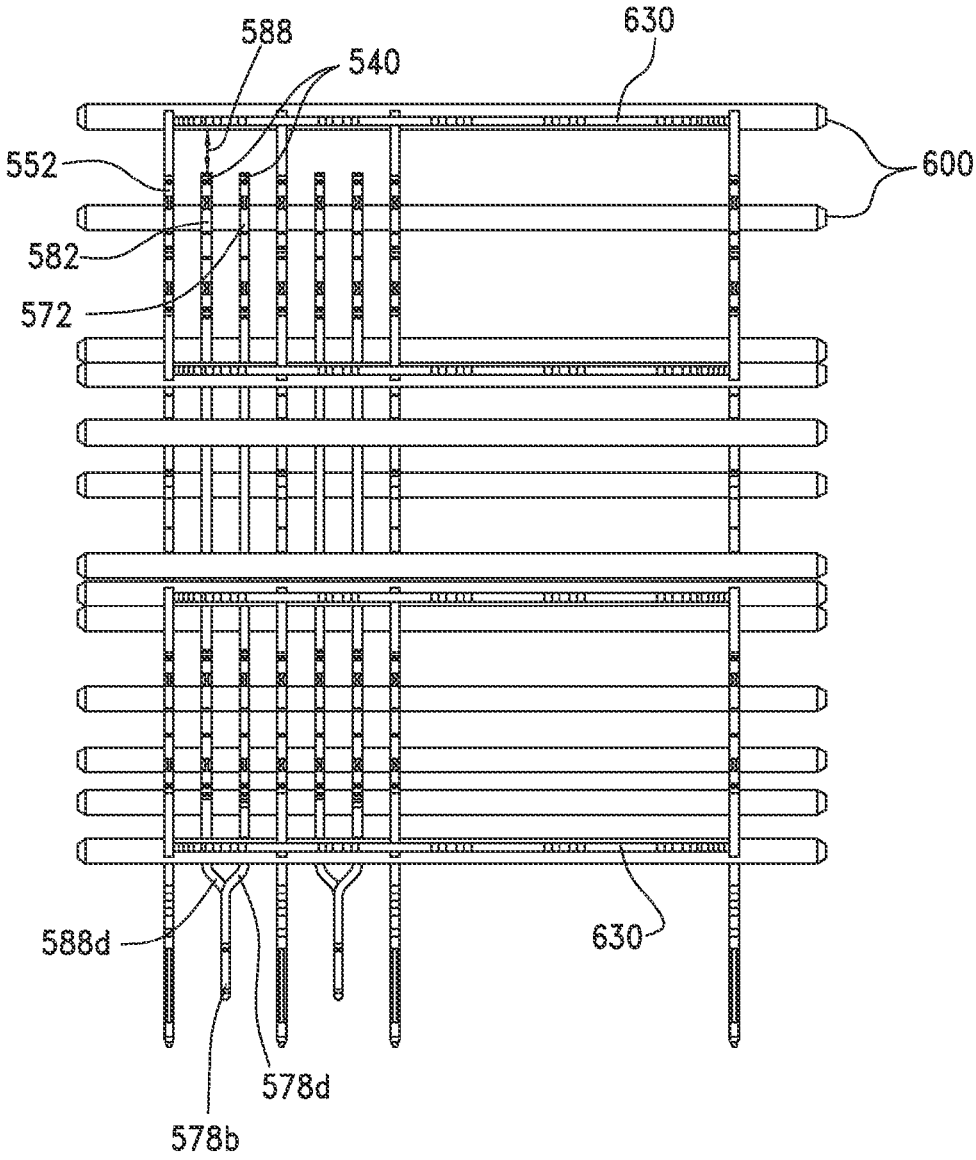
FIG. 11 is a front elevational view of the subassembly of FIG. 10.
Figure 12:
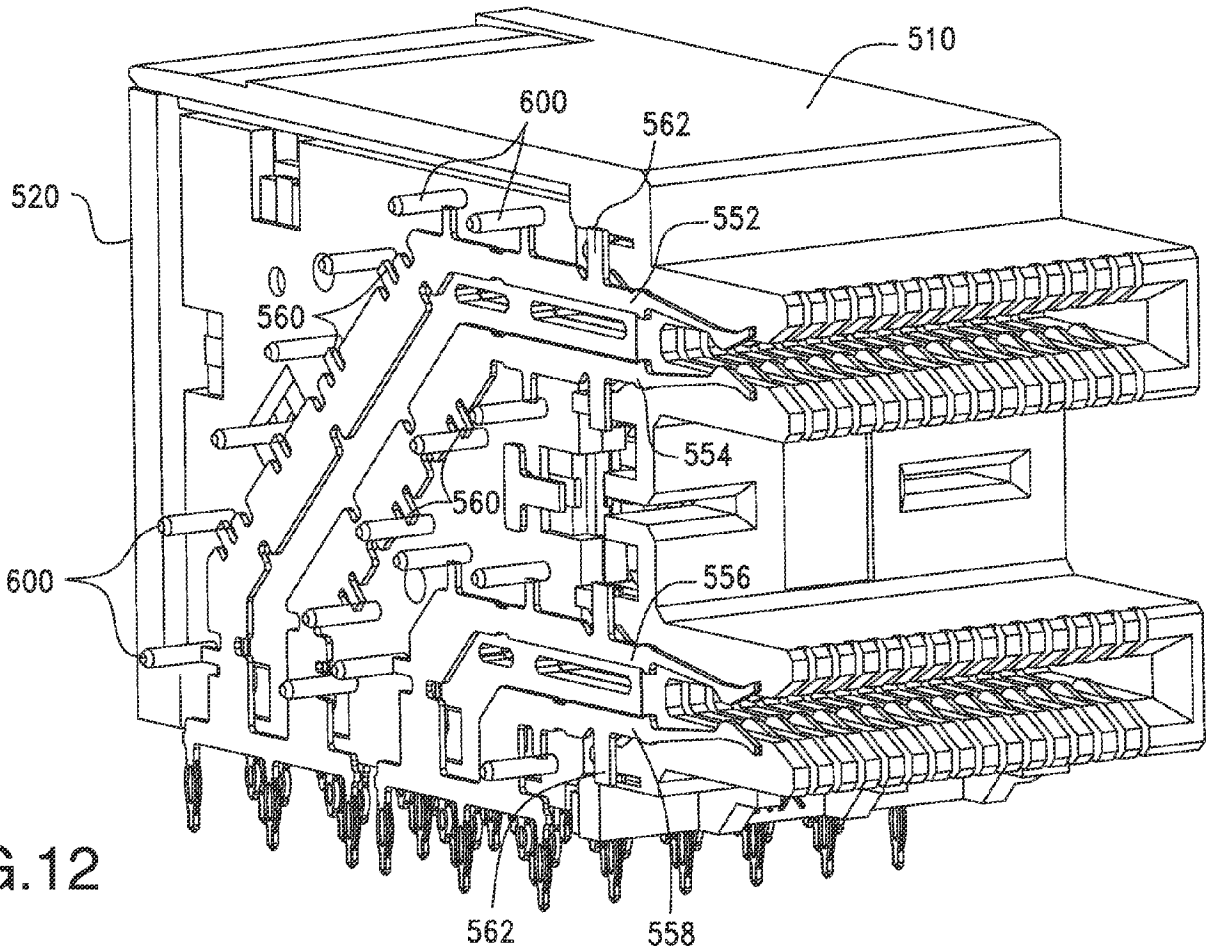
FIG. 12 is a sectioned perspective view of FIG. 1 taken generally along line 12-12 of FIG. 1.
Figure 13:
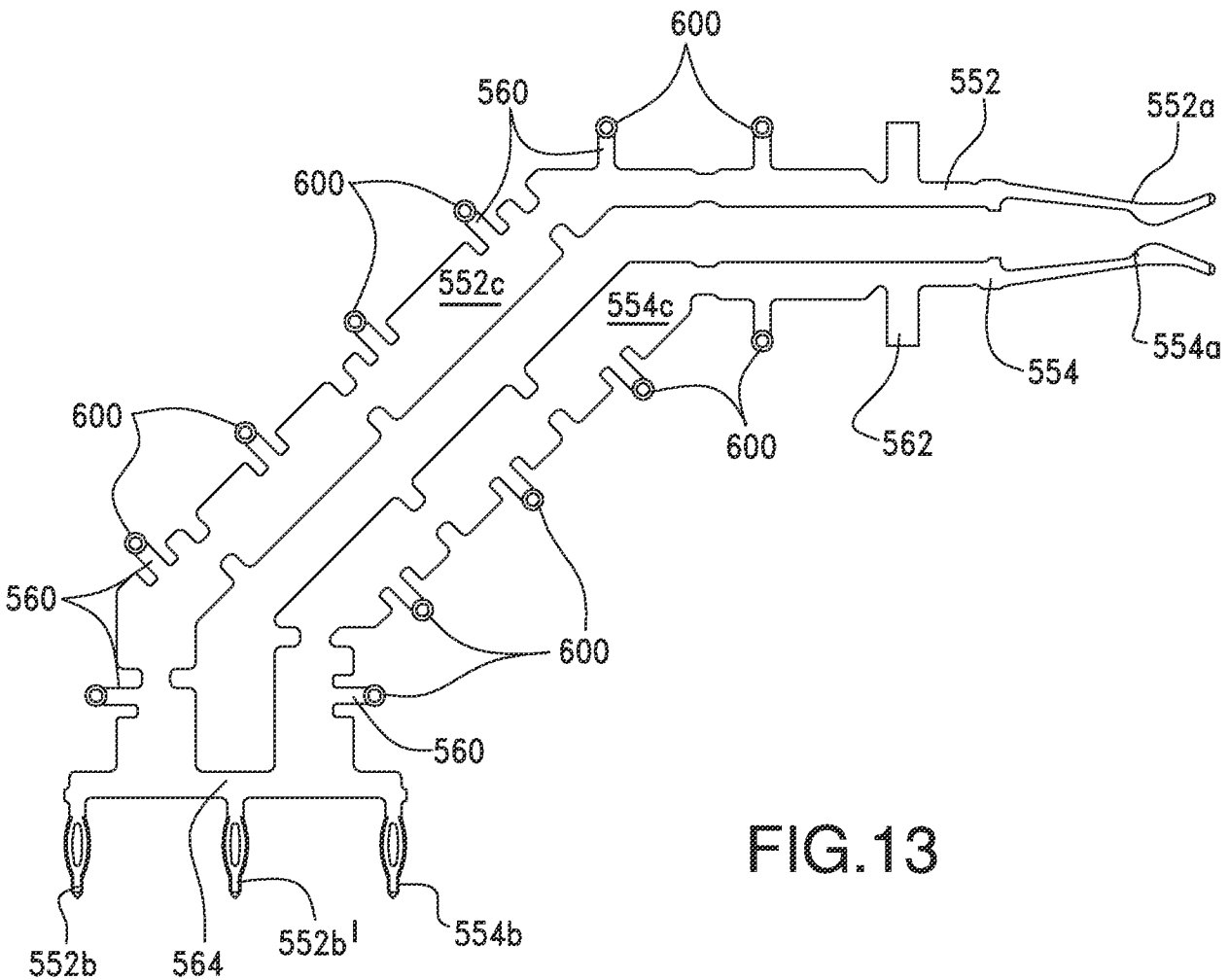
FIG. 13 is a side elevational view of a pair of ground terminals of FIG. 12.

The bridges extend transversely across the signal terminals, such as terminals 572, 582 that form the differential pair 540 (FIG. 11). To minimize electrical interference and changes in impedance, each bridge may be positioned a distance 588 from the upper surface of the signal terminals 572, 582. In an embodiment, the distance between the bridge and the terminals 572, 582 that form differential pair 540 is sufficient so that there is greater electrical separation between the bridge and the differential pair 540 than there is between the two terminals that form the differential pair.

Figure 14:
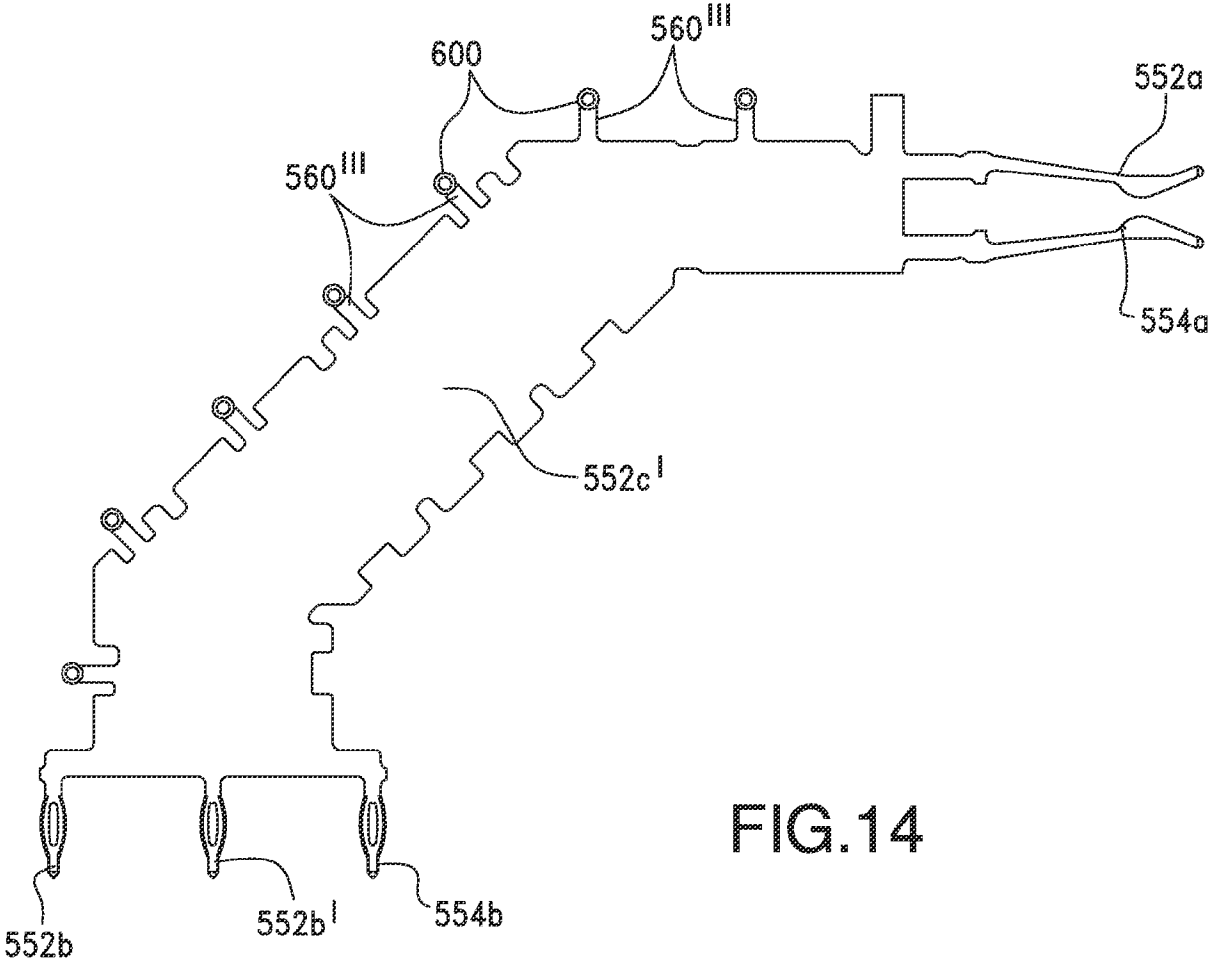
FIG. 14 is a side elevational view of an alternate embodiment of the ground terminals depicted in FIG. 13.
Figure 15:
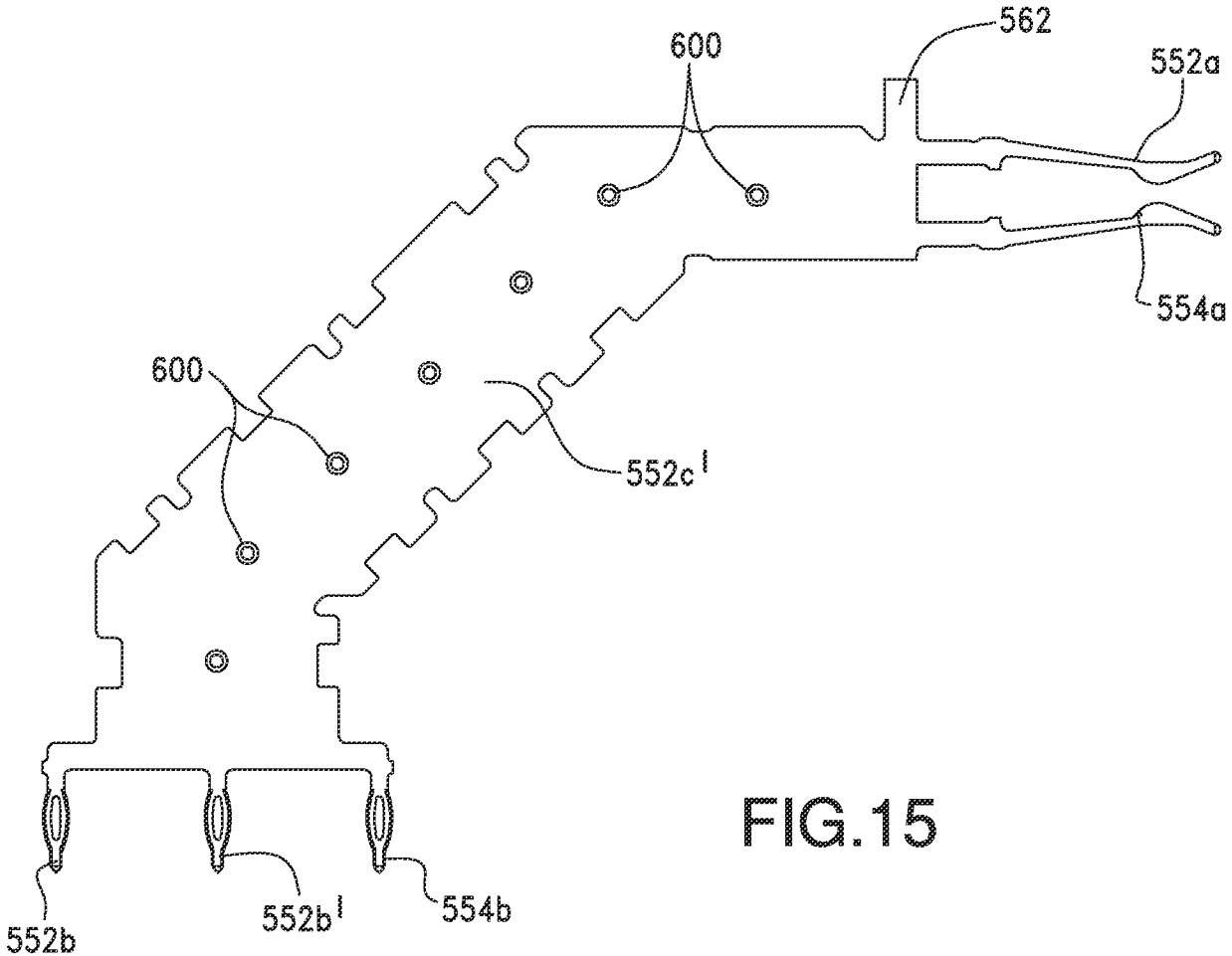
FIG. 15 is a side-elevational view of still another alternate embodiment of the ground terminals depicted in FIG. 14.

As described above, the pairs of upper and lower ground terminals 552, 554 in the first projection 530 may be coupled by a first joining member 564 proximate to ground tails 552*b*, 554*b* and the pairs of upper and lower ground terminals 556, 558 in the second projection 532 may be coupled by second joining member 566 proximate to ground tails 555*b*, 558*b*. These joining members can help further reduce potential differences between ground terminals and improve the overall performance of connector 500. As can be appreciated from FIGS. 13-15, alternative embodiments of the ground terminals may be provided such as enclosing the space between the body sections 552*c*, 554*c* of ground terminals 552, 554 to create a single ground terminal body 552*c*' to shield both of the signal terminals 572, 574 in the upper and lower rows of first projection 530. Such a terminal could include fingers 560 extending from the upper and lower edges of the body or might include fingers 560''' extending from only one side (such as depicted in FIG. 14) or could include pins 600 extending through the middle of the ground terminals with an interference fit (as depicted in FIG. 15).

Figure 19:
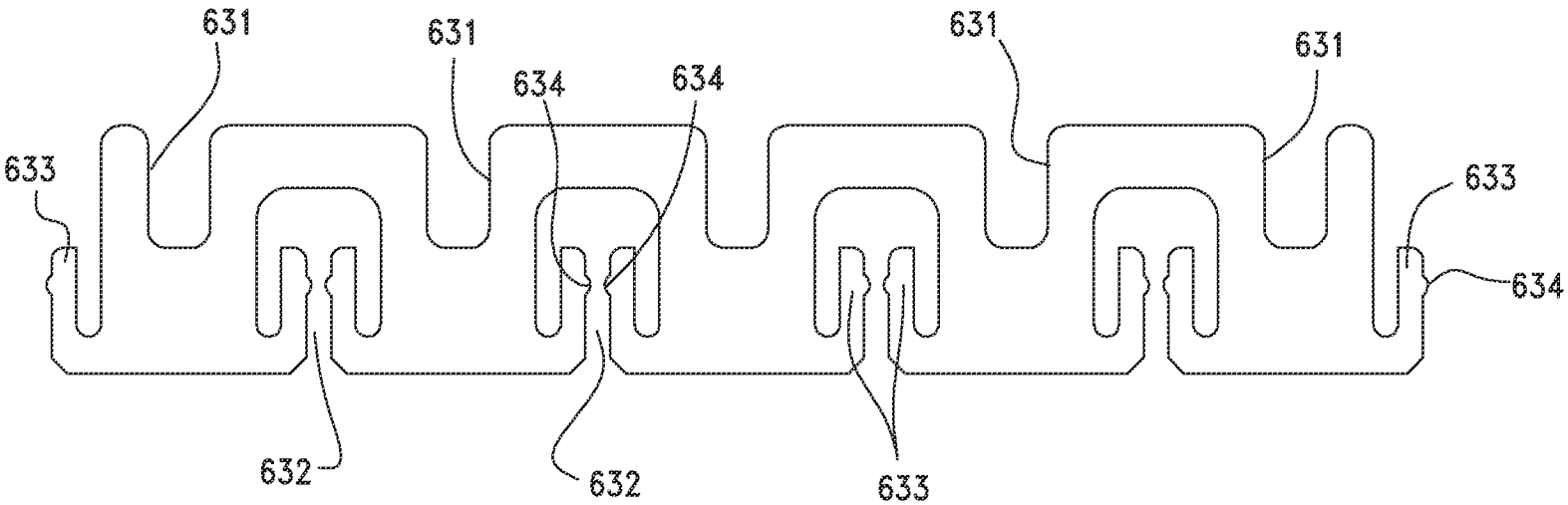
FIG. 19 is a top plan view of the front bridging structure.
Figure 20:
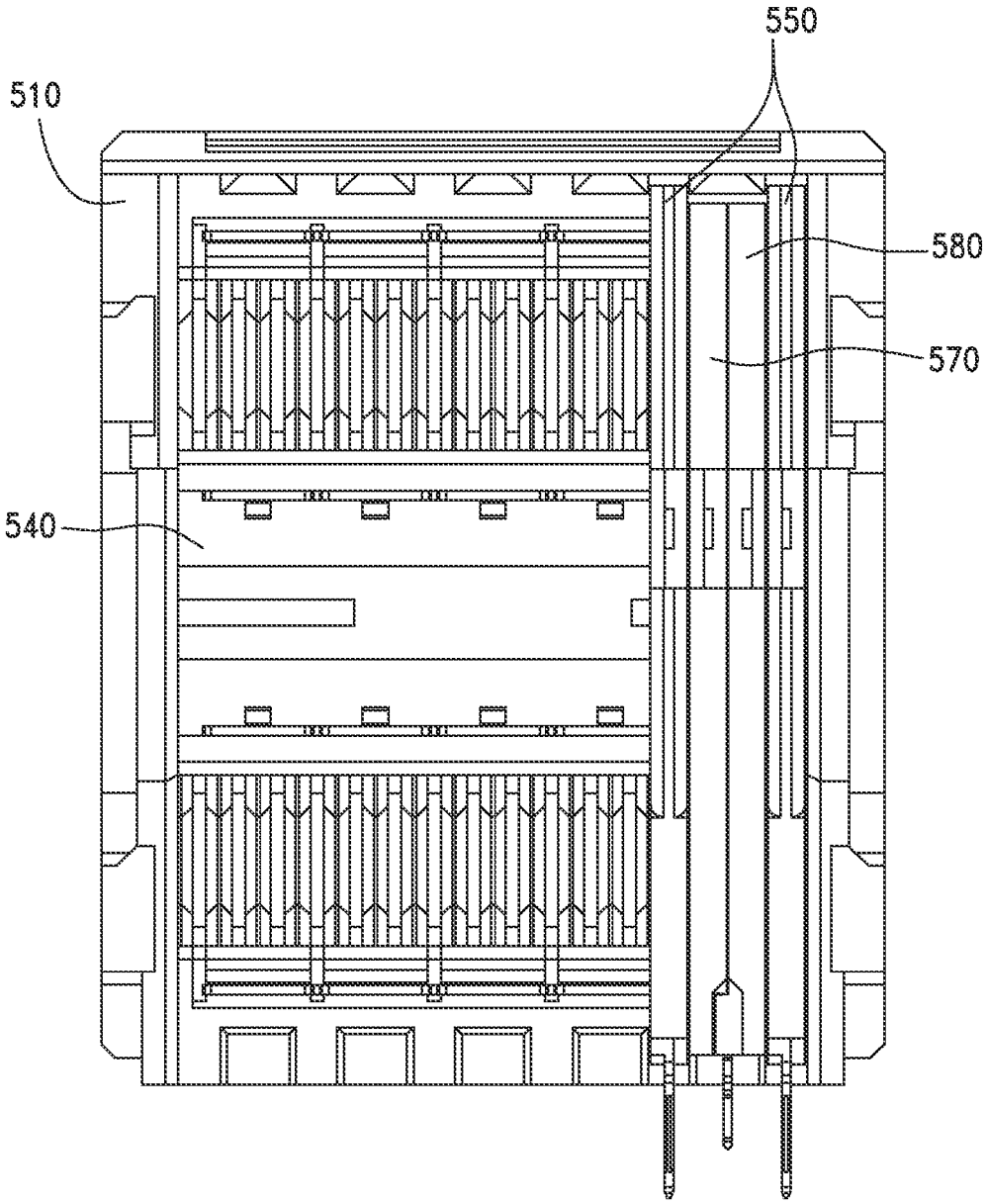
FIG. 20 is a rear elevational view of the electrical connector of FIG. 1 with the rear housing component removed and only two ground and two signal wafers inserted into the front housing component.
Figure 21:
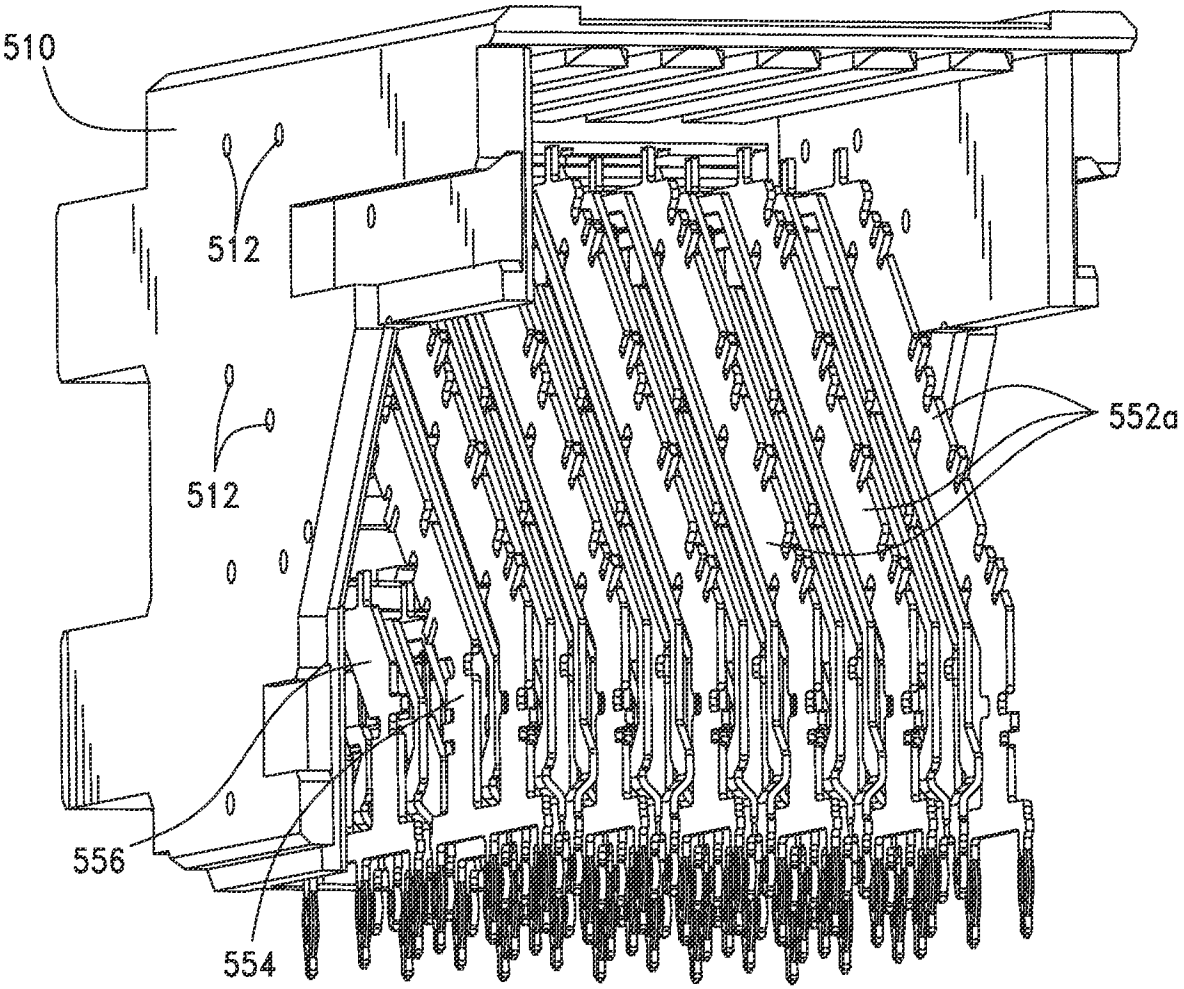
FIG. 21 is a rear perspective view of the electrical connector of FIG. 1 but with the rear housing component and insulation around the wafers removed for clarity.
Figure 21A:
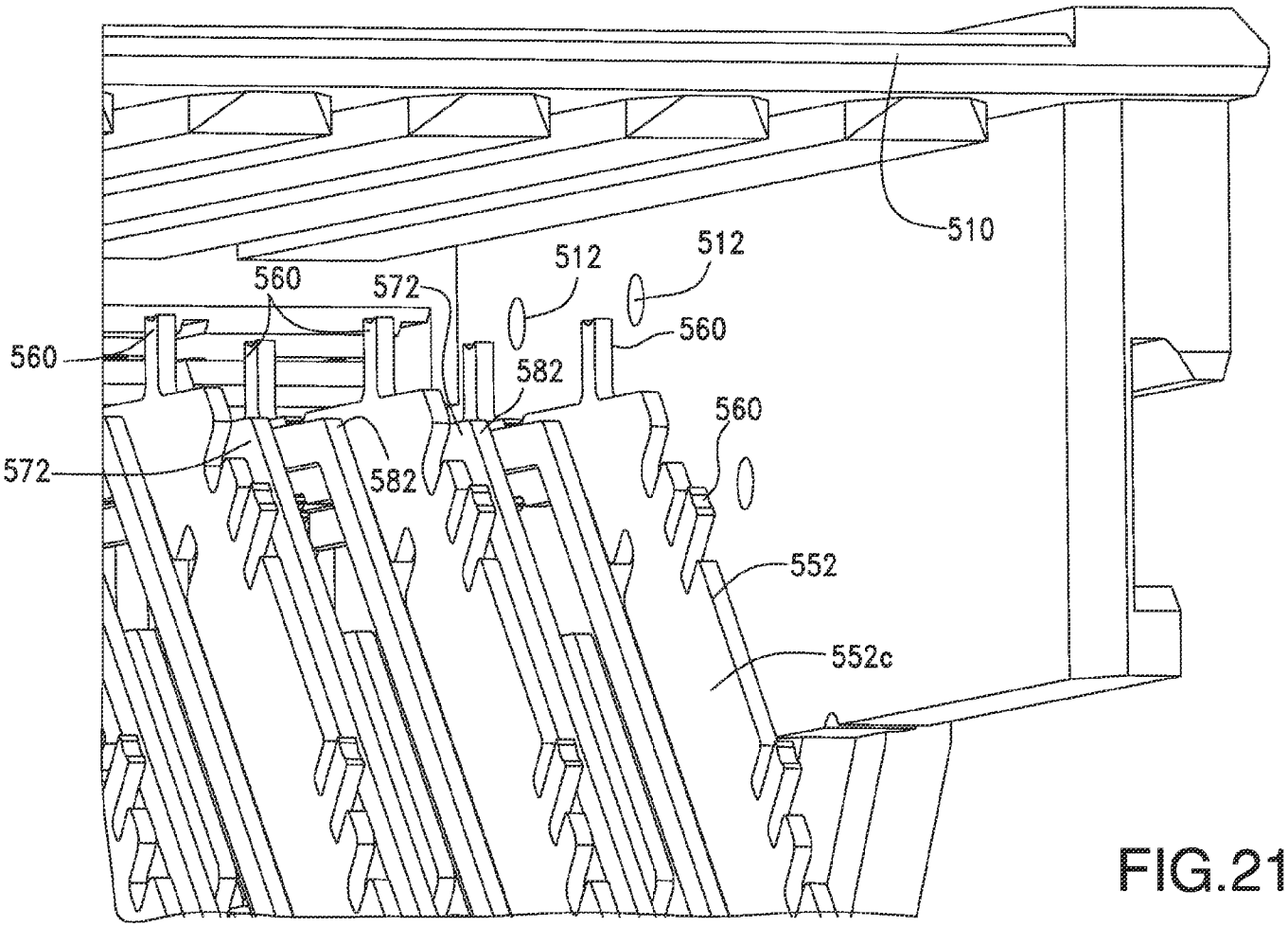
FIG. 21A is an enlarged perspective view of a portion of FIG. 21.
Figure 22:
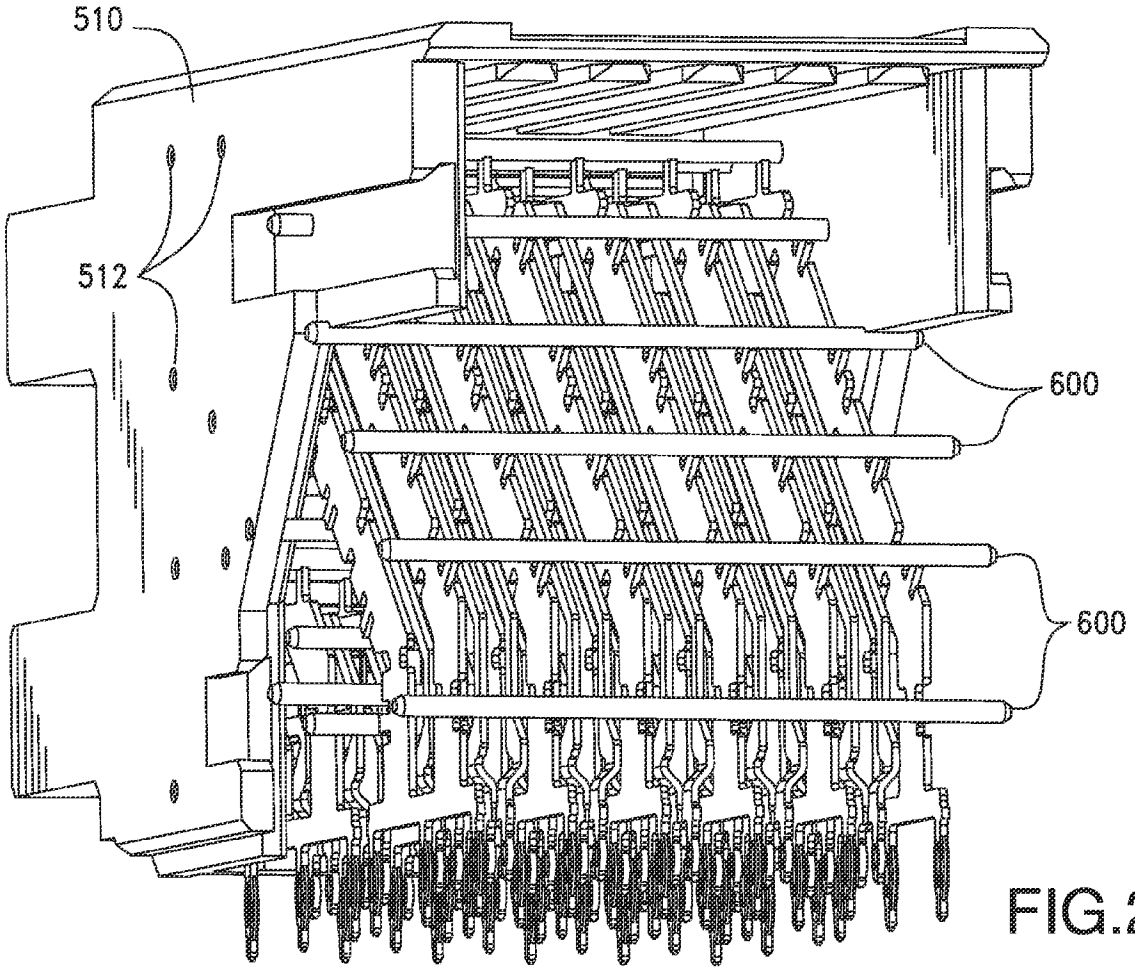
FIG. 22 is a rear perspective view similar to FIG. 21 but with bridging pins inserted.
Figure 22A:
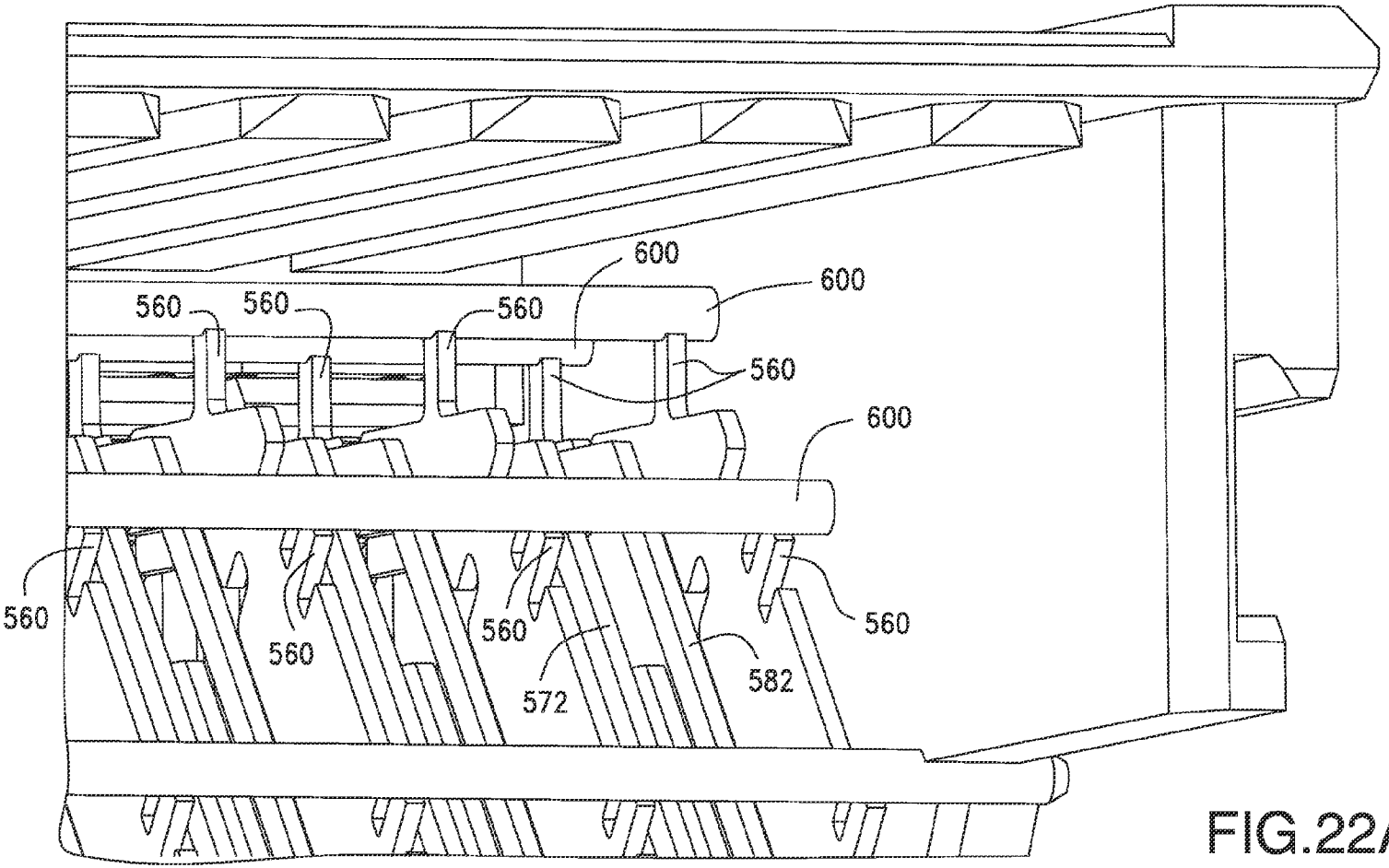
FIG. 22A is an enlarged perspective view of a portion of FIG. 22.
Figure 23:
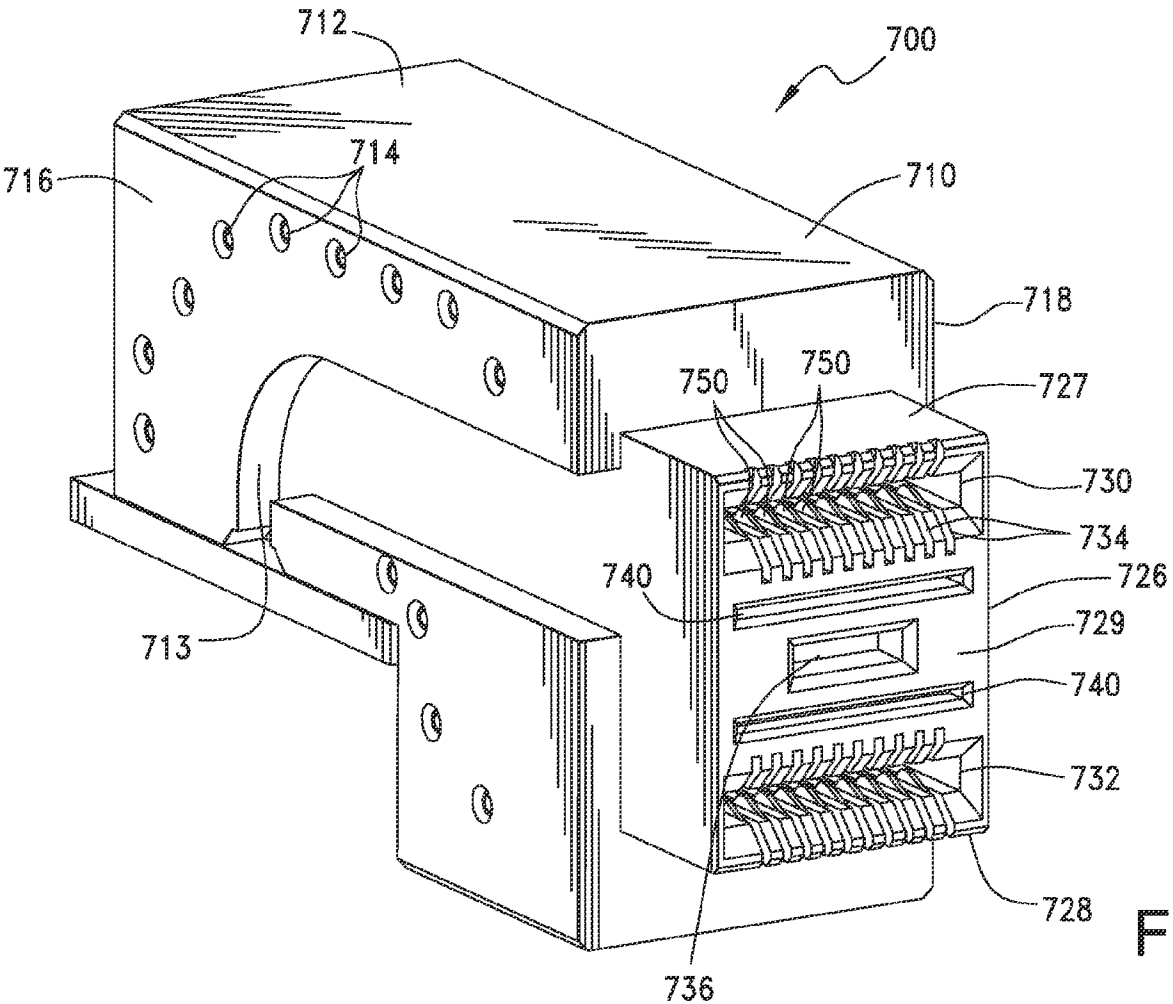
FIG. 23 is a front perspective view of another embodiment of an electrical connector.
Figure 24:
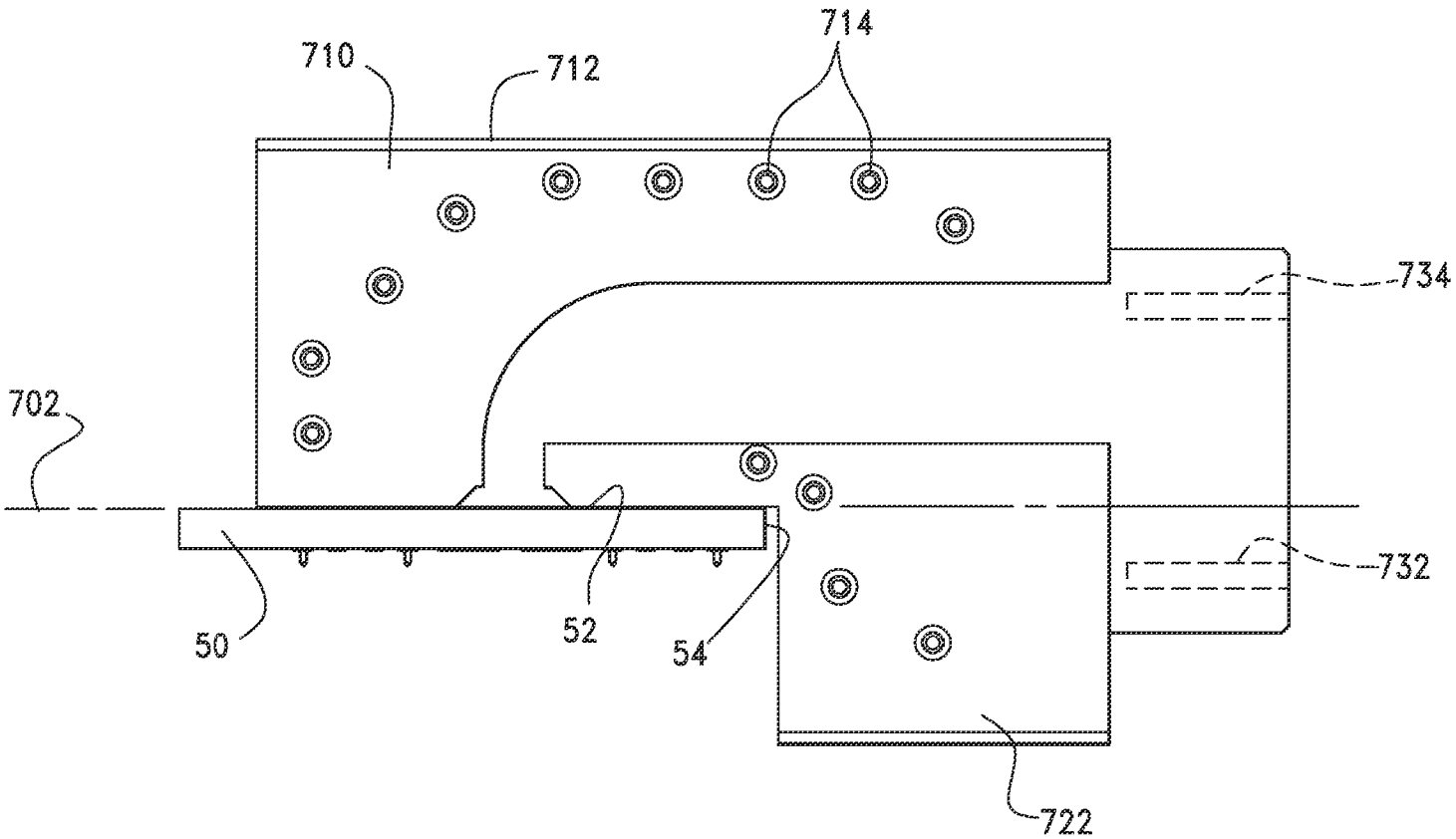
FIG. 24 is a side elevational view of the electrical connector of FIG. 23.
Figure 25:
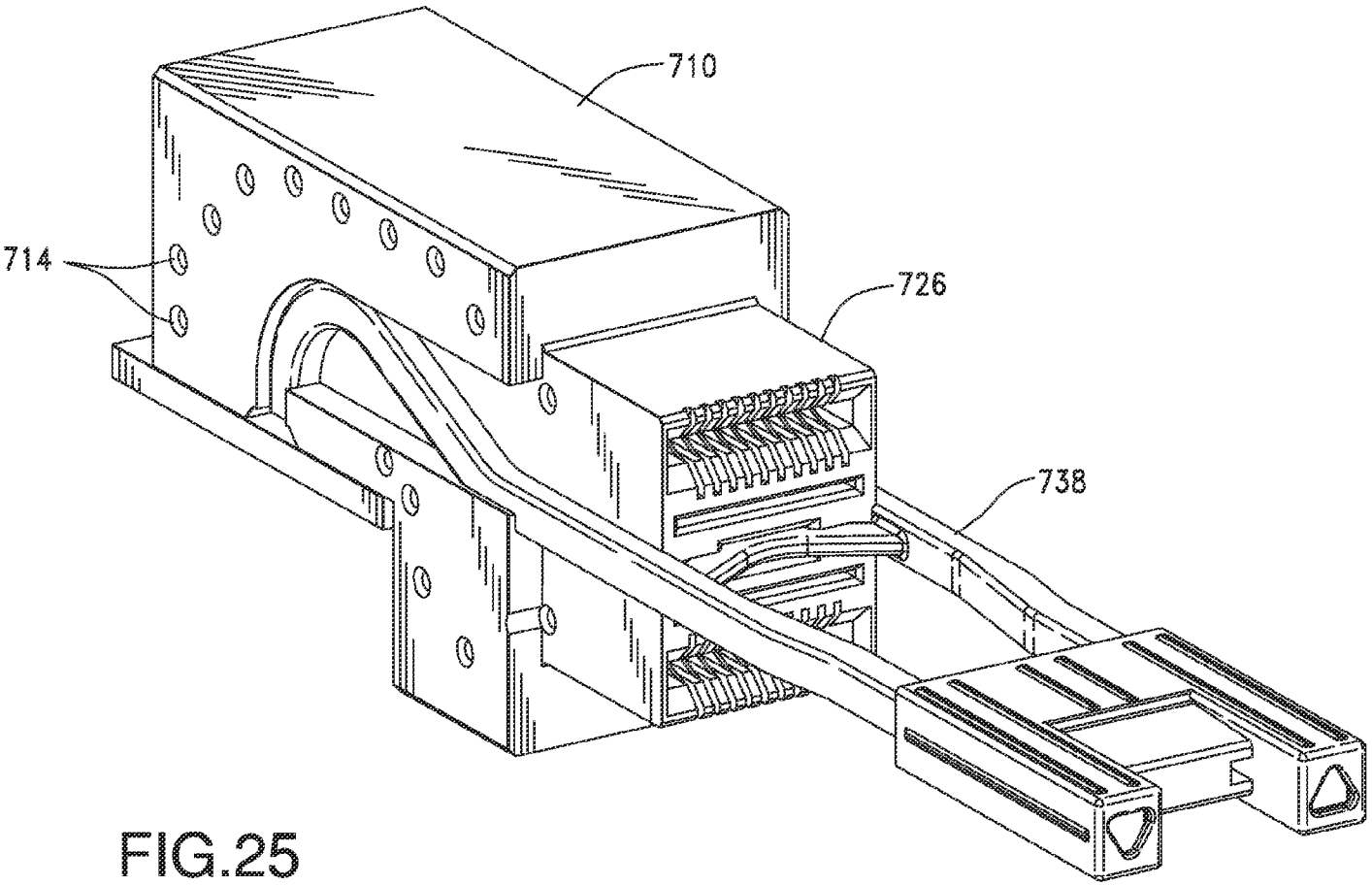
FIG. 25 is a perspective view of the electrical connector of FIG. 23 incorporating a light pipe assembly.
Figure 26:
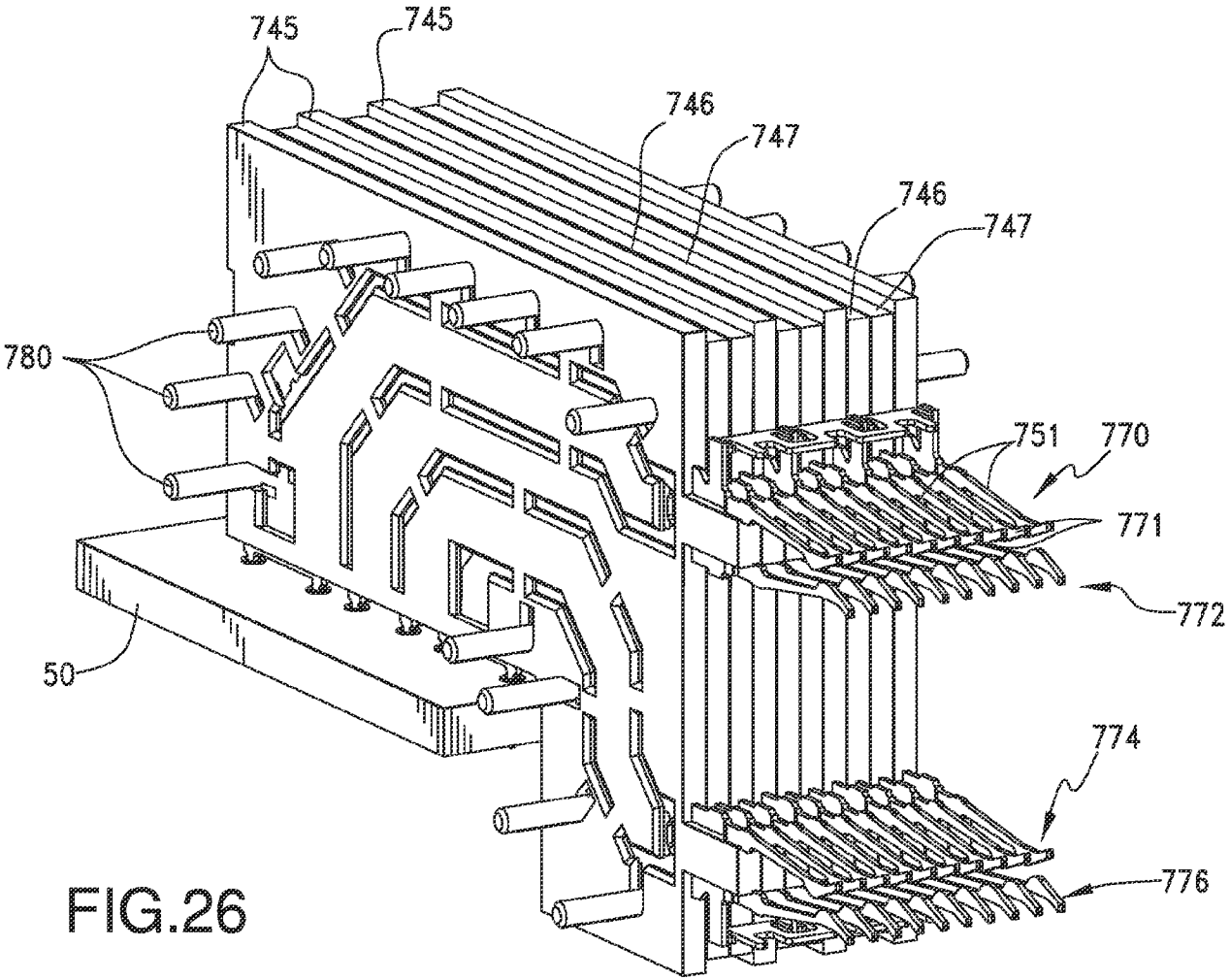
FIG. 26 is a front perspective view of the electrical connector of FIG. 23 but with the front and rear housing components removed in order to show the subassembly of internal wafers.

Referring to FIG. 19, an embodiment of a bridge is illustrated. The bridge is provided by a clip 630 which is inserted into the first housing component 510 prior to insertion of wafers 550, 570, 580. The clip 630 is conductive and may be once piece as shown. The clip 630 can include a plurality of spaced apart engagement notches 631 that engage projections on first housing component 510 so that the first housing component 510 retains the clip 630 therein with a press-fit type engagement. The clip 630 includes a plurality of spaced apart receiving channels 632, which can be on an edge opposite notches 631, with each channel having a pair of opposing spring arms 633 therein. As depicted, the distance between spring arms 633 is less than the thickness of wide tab 562 in order to establish a good electrical connection between the spring arms 633 and wide tab 562 upon insertion of wide tab 562 between spring arms 633. If desired, a bump or projection 634 may be provided on each spring arm 633 in order to increase the reliability of the contact between the spring arms and the wide tab.

Clip 630 is preferably formed of an appropriate conductive material having sufficient spring and strength qualities so as to reliably retain clip 630 within front housing component 510 and maintain a reliable connection between spring arms 633 and wide tabs 562. It may be desirable to use clip 630 in situations in which it is difficult to insert a pin 600 near the mating ends 552*a*, 554*a*, 556*a*, 558*a* of ground terminals 552, 554, 556, 558. Depending on the available space within the connector 500, channels 632 may be omitted from the outer lateral edges of clip 630 and replaced by a single spring arm 633 in which case the wide tabs of the outer ground wafers will only be engaged by a single spring arm 633. Although clip 630 is depicted in FIGS. 1-28 as a one-piece member, if desired, clip 630 could be formed of multiple components 890 (FIGS. 29-34) that are secured within front housing component 510.

During the assembly process, the wafers supporting the terminals may be inserted into the housing in a number of different manners. Some examples of the assembly process include: 1) individually loading or stitching the wafers into the housing in the sequence in which they are aligned in the housing (e.g., G $S^+$ $S^-$ G $S^+$ $S^-$ G); 2) inserting all of the wafers of a first type (e.g., all of the ground wafers 550) into cavity 540, inserting all of the wafers of a second type (e.g., all of the first signal wafers 570) into cavity 540 and this process repeated until the cavity is fully populated; 3) configuring the wafers carrying the signal terminals so that the two signal wafers 570, 580 are coupled together first and then inserting the coupled wafer pair into the housing; or 4) coupling or positioning all of the wafers together in the desired pattern and then inserting the coupled subassembly of wafers into cavity 540 in a single loading operation.

For the first three assembly processes listed above, after the wafers 550, 570, 580 have been inserted into first housing 510, pins 600 can be inserted into connector 500. If the fingers 560 are all co-planar with body sections 552*c*, 554*c*, 556*c*, 558*c*, pins 600 may be inserted from either side of the connector. More specifically, pins 600 could be inserted through the pin receiving apertures in either side of first housing component 510 and through the pin receiving apertures in either side of second housing component 520. If desired, the pins 600 may extend essentially the entire width of connector 500 and through the pin receiving apertures on both sides of first housing component 510 and second housing component 520.

As described above, fingers 560 may be slightly angled toward one of the sides of the respective first and second housing components 510, 520 and away from the direction of insertion of the pins 600 in order to ease insertion of the pins. As can be appreciated, in such case, it is preferable that the fingers 560 are all angled in the same direction (e.g., toward the same side) and the pins 600 could be inserted from the side opposite the side towards which the fingers are angled. In other words, fingers 560 may be bent out of the plane of the body section of their respective ground terminal and pins 600 can be inserted in the same direction as the fingers extend out of the plane of the body section.

If wafers 550, 570, 580 are coupled or positioned together in the desired pattern and then inserted as a subassembly of wafers into cavity 540 in a single loading operation as described above as the fourth assembly process, pins 600 could be inserted as described above once the wafer subassembly has been inserted into cavity 510*a* and second housing component 520 secured to first housing component 510. In the alternative, shorter pins that only extend between the opposite sides of the wafer subassembly and not through the sidewalls of first or second housing components 510, 520 could be inserted into the wafer subassembly prior to insertion of the subassembly into first housing wafer 510. In other words, the wafer subassembly may be joined by the pins and the entire subassembly inserted as a group into cavity 510*a*. In such case, apertures in the first and second housing components 510, 520 would not be necessary.

Regardless of which assembly process is used, if first housing component 510 includes a clip 630, during insertion of ground wafers 550, the wide tab 562 of each ground terminal 552, 554, 556, 558 will slide into a receiving channel 632 and between spring arms 633 in order to establish a good electrical connection between clip 630 and one of the ground terminals 552, 554, 556, 558. In other words, in an embodiment the clip can be first inserted into the housing component 510 and then the wafers can be inserted in the housing component 510 so that the ground terminals engage the clip 630.

Referring to FIGS. 23-28, an embodiment of a connector 700 is depicted that is similar to that of FIGS. 1-22A except that the seating plane 702 (i.e., the plane of the circuit board on which the connector is mounted) has been moved upward so that the plane of one of the circuit card slots (lower slot 732 as depicted) is positioned below the plane of upper surface 52 of the circuit board 50. Connector 700 includes a housing 710 with a first surface 712, a first side 716 and second side 718. Apertures 714 in the first side allow pins 740 to be inserted into the connector 700. Projection 726, which includes first surface 727 and second surface 728, includes two vertically spaced apart card slots 730, 732 therebetween. The card slots 730, 732 may be chamfered and include terminal receiving grooves 734 for supporting terminals 750 inserted therein.

The sides of the connector 700 may include a curved wall 713 configured to retain a light pipe and may further include a shoulder 720 to help support the light pipe. If desired, a front face 729 of projection 726 may include apertures, such as aperture 736, to support a light pipe assembly 738. Slots 740 may be used to support shielding members (not shown).

The depicted housing 710 includes a block 722 that extends past an edge 54 of the circuit board 50 while the upper surface 52 of the circuit board 50 supports the connector. As can be appreciated, the depicted connector, while providing a press-fit (or thru-hole) mounting interface with respect to the circuit board, also allows the lower circuit card slot 732 to be positioned below the upper surface 52 of the circuit board. Thus, the depicted embodiment provides an advantageously compact and low profile package.

Figure 27:
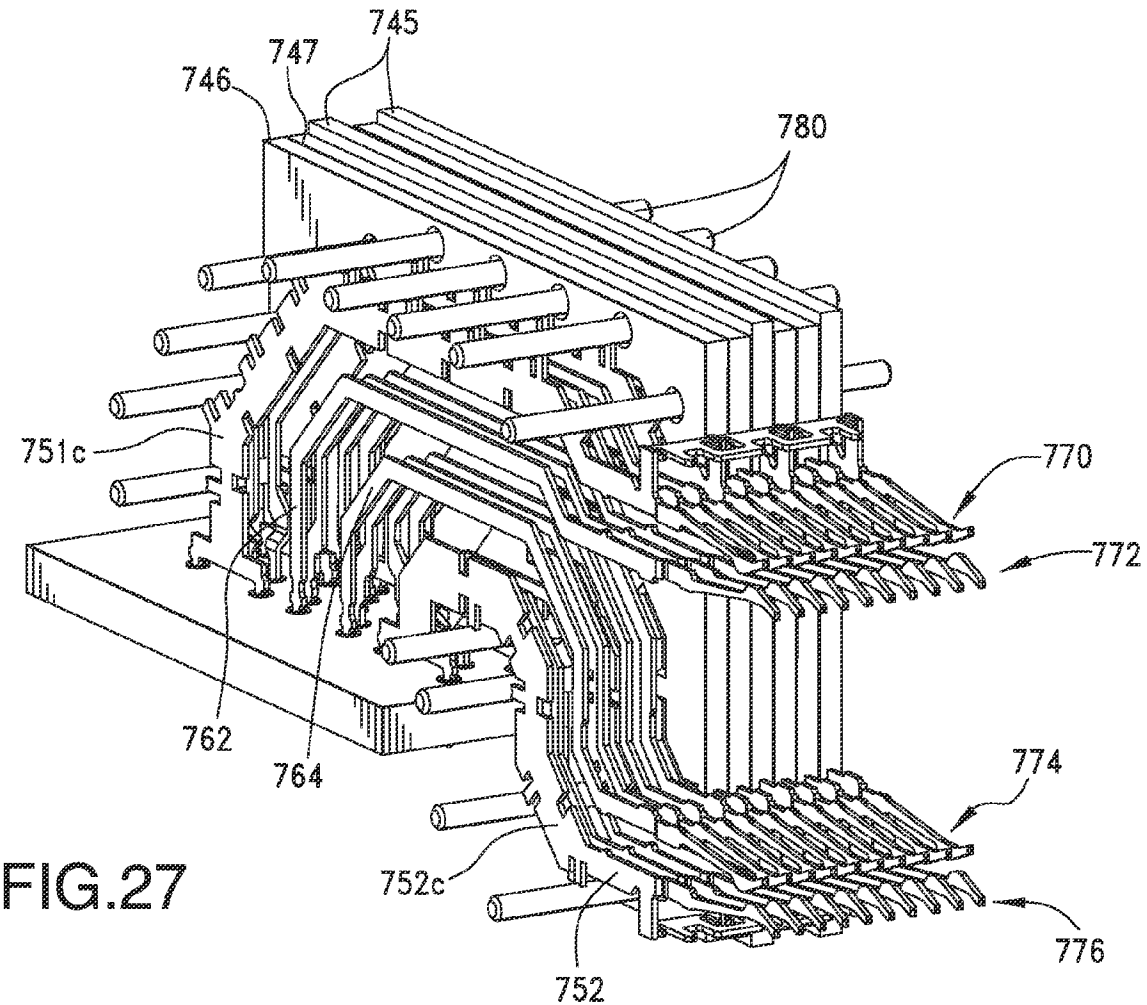
FIG. 27 is a front perspective view similar to FIG. 26 but with the insulation removed from some of the wafers.
Figure 28:
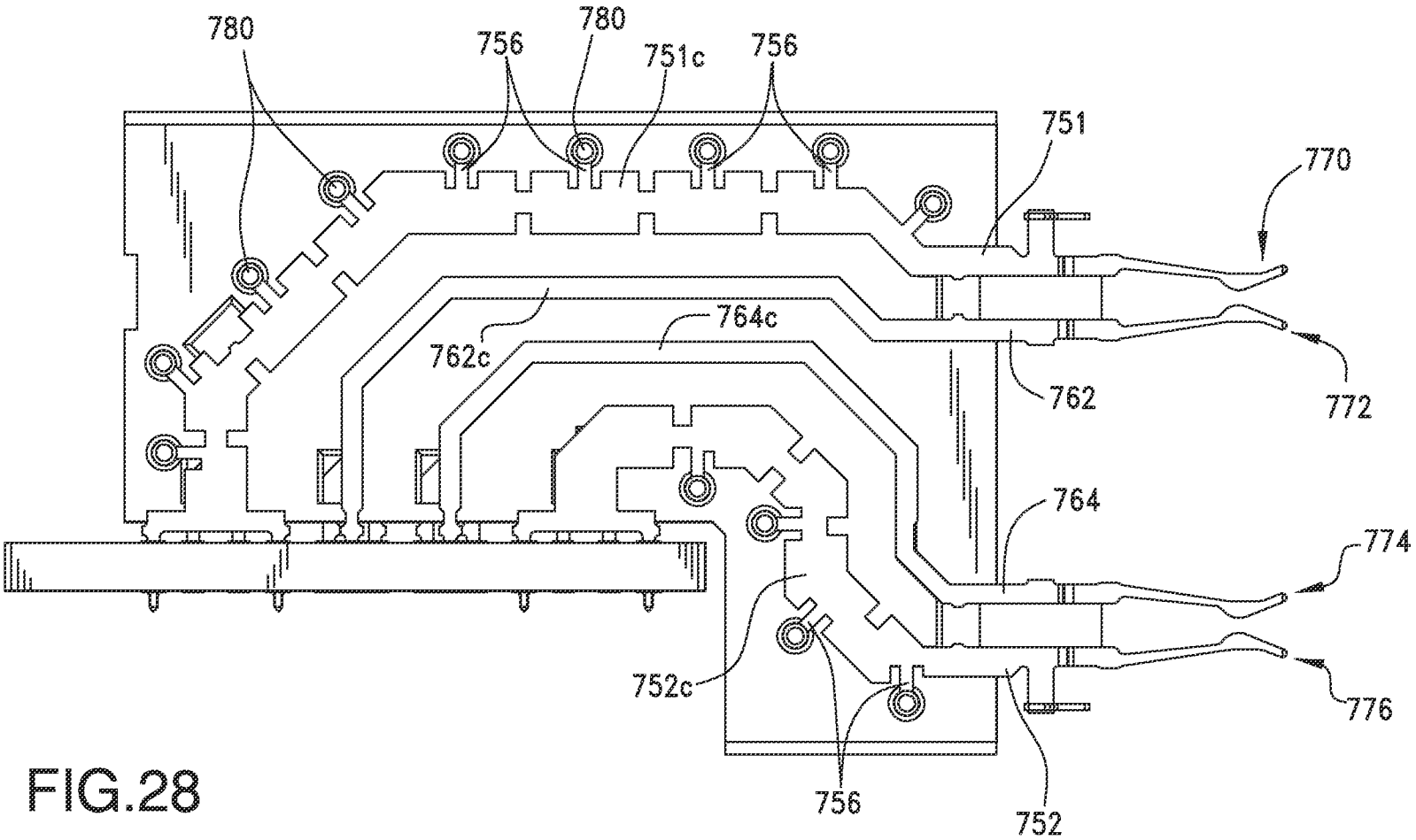
FIG. 28 is a side elevational view of FIG. 27.
Figure 29:
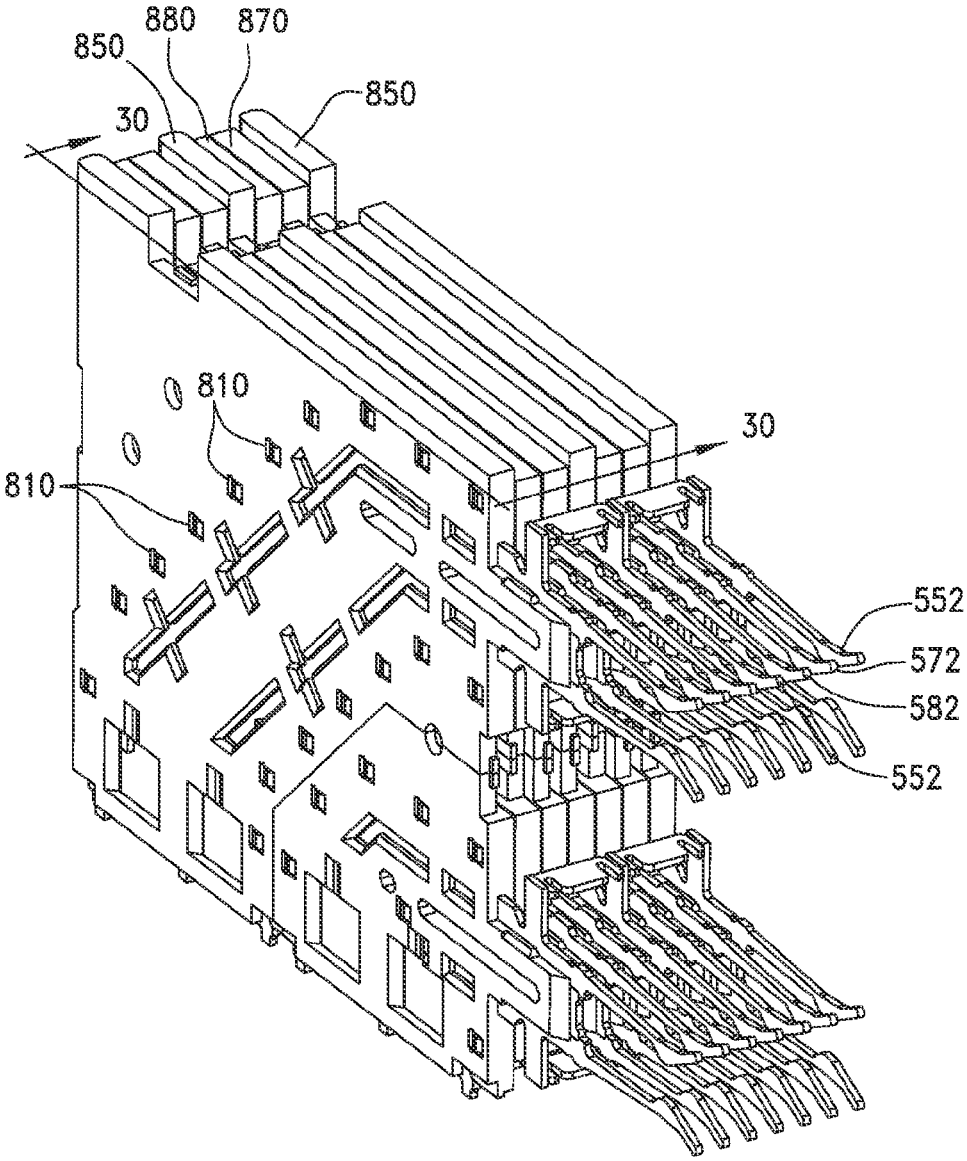
FIG. 29 is a perspective view of a subassembly of wafers utilizing an alternate form of grounding clips.
Figure 30:
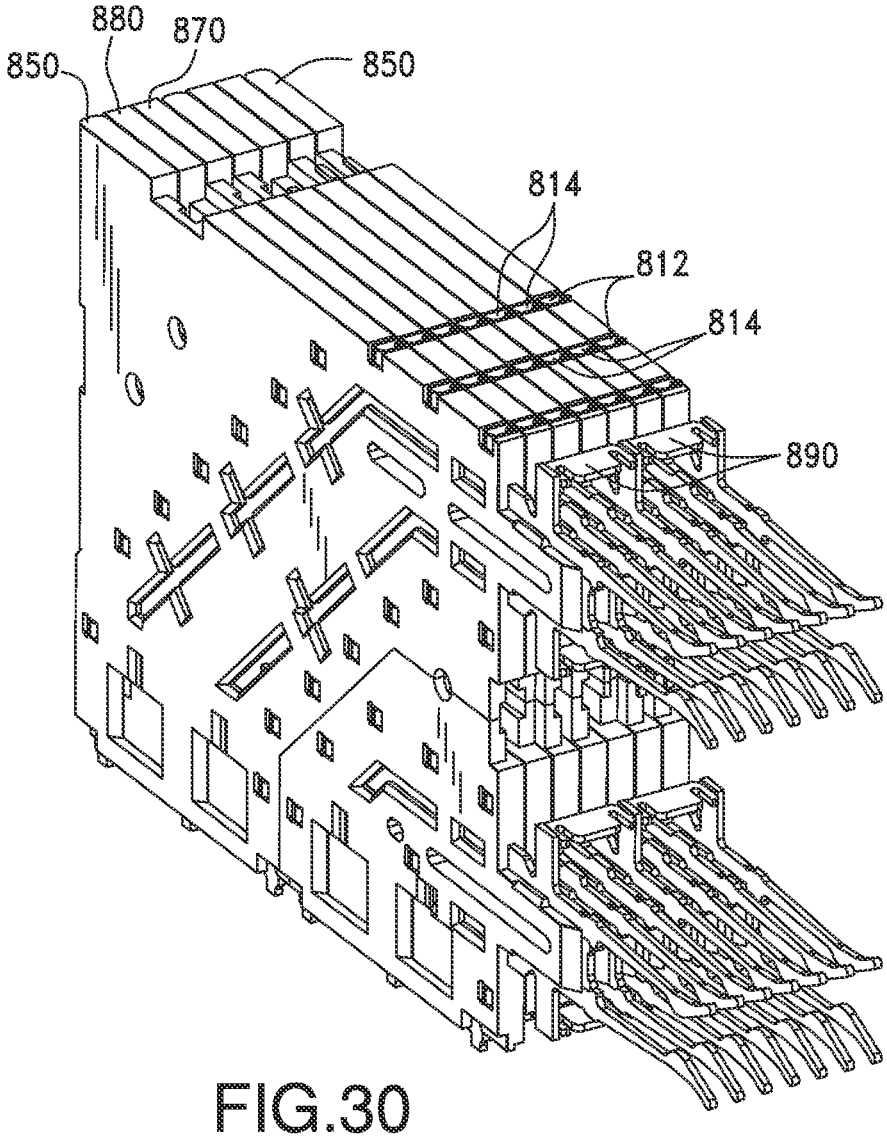
FIG. 30 is a sectioned perspective view of FIG. 29 with the insulation above line 30-30 of FIG. 29 removed for clarity.
Figure 30A:
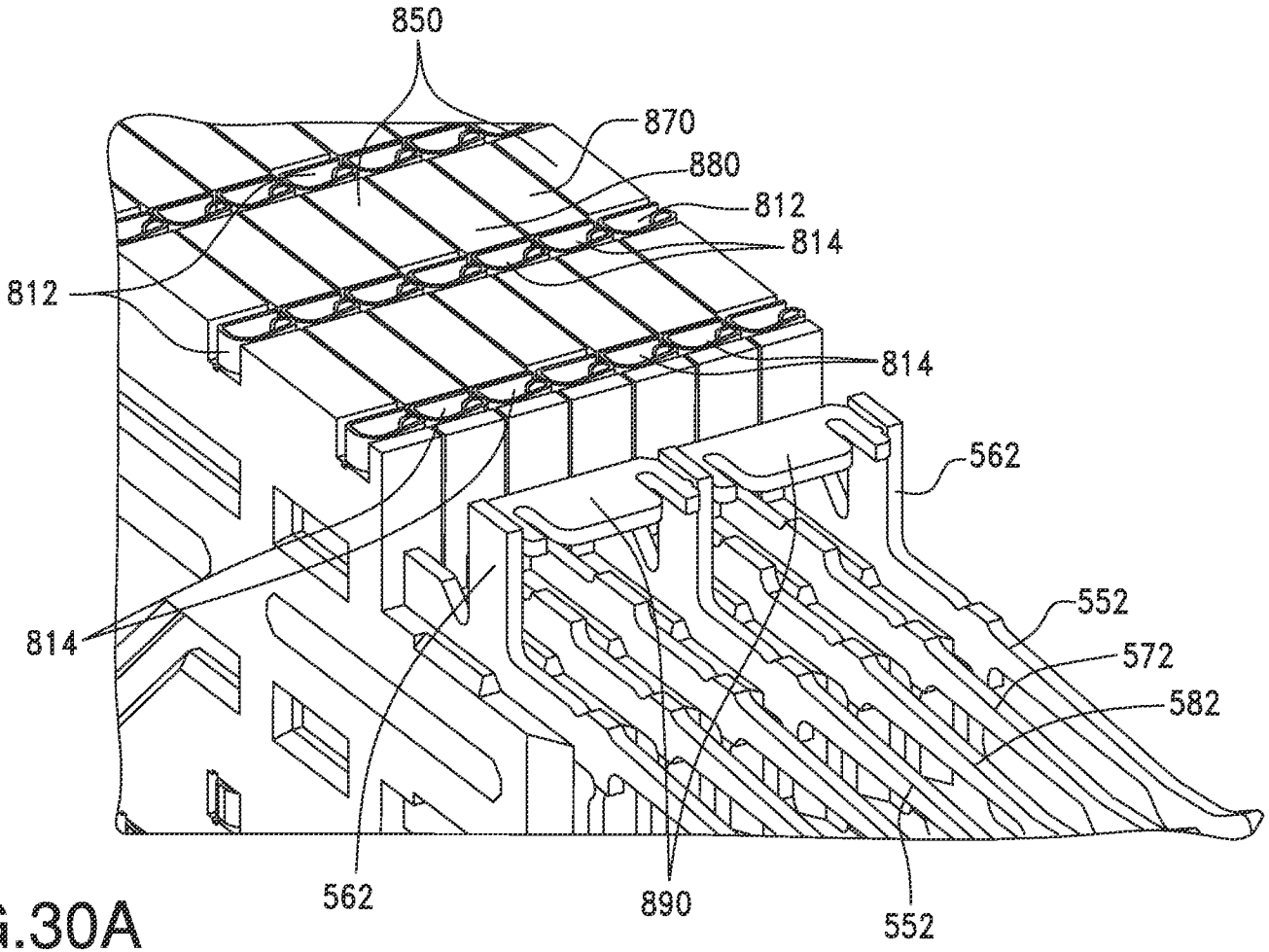
FIG. 30A is an enlarged perspective view of a portion of FIG. 30.
Figure 31:
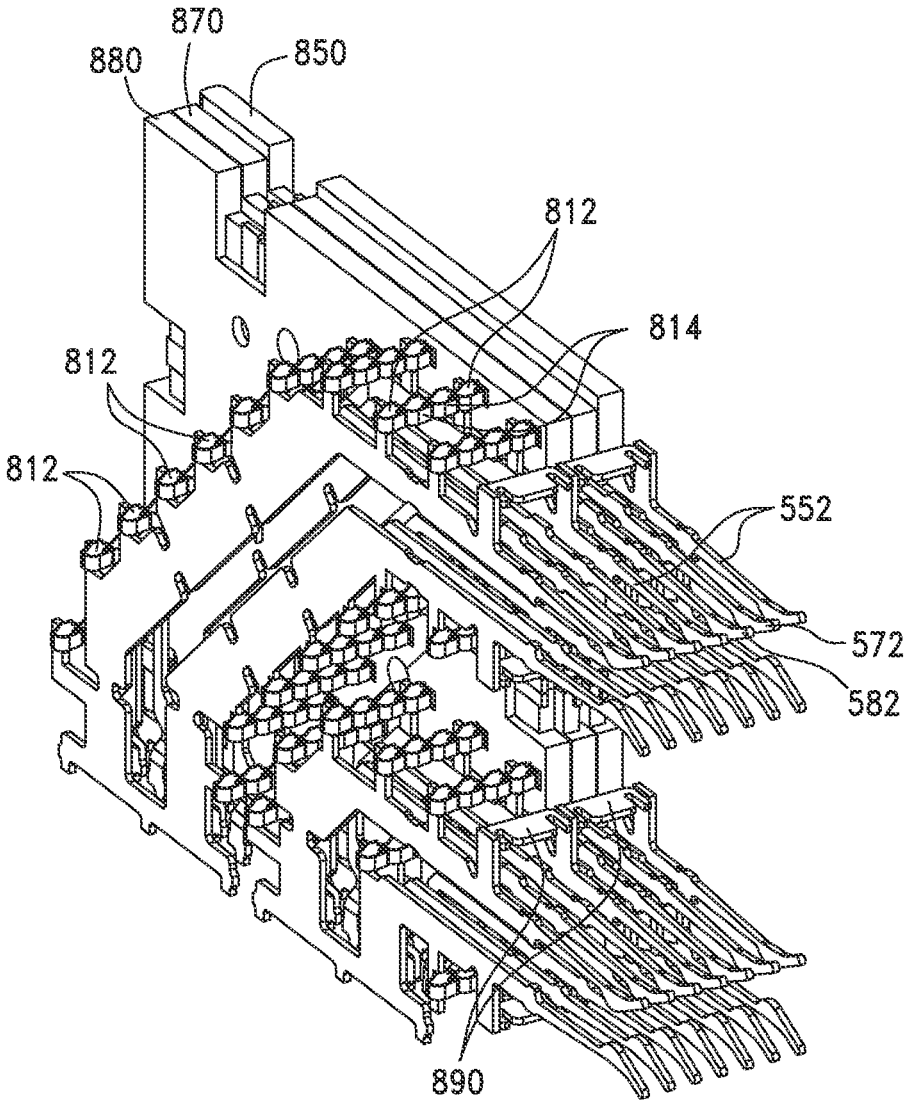
FIG. 31 is a perspective view similar to that of FIG. 29 but with the insulation removed from four of the wafers for clarity.

As with connector 500, connector 700 includes an alternating array of wafers 745, 746, 747. Wafers 745, 746, 747 are similar in construction to wafers 550, 570, 580 except that the seating plane 702 of connector 700 has been moved as compared to the seating plane of connector 500. In addition, ground wafer 745 is different from ground wafer 550 in that it includes both ground terminals and signal terminals therein. More specifically, as best seen in FIGS. 27, 28, ground wafer 745 includes four terminals with the topmost and bottommost terminals 751, 752 being configured as ground terminals with wide body sections 751*c*, 752*c* and resilient tabs or fingers 756 extending therefrom. The middle two terminals 762, 764 are configured in a manner similar to the signal terminals 755 with the body sections 762*c*, 764*c* thereof being substantially narrower than the body sections 751*c*, 752*c* of the ground terminals.

As depicted, a first row 770 of terminals includes a plurality of pairs of differentially coupled high data rate signal terminals 771 with ground terminals 751 on opposite sides of each pair. Pins 780 engage fingers 756 of ground terminals 751 to common the ground terminals as described above in order to provide a desired maximum effective electrical length. A second row 772 of terminals 762 within the first card slot 730 has a similar configuration but does not include high data rate terminals and commoned ground terminals and thus the upper card slot 730 (which includes the first and second rows 770, 772) is configured for a high data rate version of the SFP-type connector (as SFP-style connectors include two high data rate channels in one of the two rows). The second card slot 732 is configured in a manner that is similar to the first card slot 730 as it has a third row 774 of terminals 764 not including commoned ground terminals while a fourth row 776 of terminals includes a pair of differentially coupled high data rate signal terminals 778 with commoned ground terminals 752 on opposite sides of each pair. Thus, both the first and second card slots 730, 732 are suitable for use in a high data rate variant of a SFP connector but the second card slot is rotated 180 degrees with respect to the orientation of the high data rate terminals surrounded by commoned ground terminals. Terminals 762, 764 of the middle two rows of terminals can be used as desired for lower-speed signals and/or power or the like. In an embodiment, the high data-rate terminals rows may be configured so that they are suitable for 17 Gbps performance or even 20 or 25 Gbps. As can be appreciated, flipping the orientation of the second card slot with respect to the first card slot is advantageous from a standpoint of signal separation in a dense package but is not required.

FIGS. 29-32 illustrate a subassembly of wafers similar to that of FIGS. 1-22A but which include an alternate embodiment of a structure for bridging the ground terminals in the wafers. Accordingly, like reference numbers are used with respect to like elements and the description of such elements is omitted. Wafers 850, 870, 880 include apertures 810 therethrough in which individual conductive, identically shaped, resilient ground clips 812, 814 are positioned. Ground clips 812, 814 may be inserted into apertures 810 either before or after molding of the plastic insulation around wafers 850, 870, 880. The ground clips 812, 814 are configured to extend slightly beyond at least one side surface of its respective wafer so that each clip engages the clips on opposite sides thereof. In addition, the ground clips 812 associated with each ground wafer 850 also engage a tab 816 extending away from body section 552*c*, 554*c*, 556*c*, 558*c* of the ground terminals 552, 554, 556, 558. Wafers 870, 880, which include the high data rate signal terminals, are positioned between two ground wafers 850 so that grounding clips 814 of the signal wafers engage the grounding clips 812 of the ground wafers and form a continuous electrical bridge that extends between ground terminals and transversely to and spaced from an edge of the high data rate signal terminals.

Figure 32:
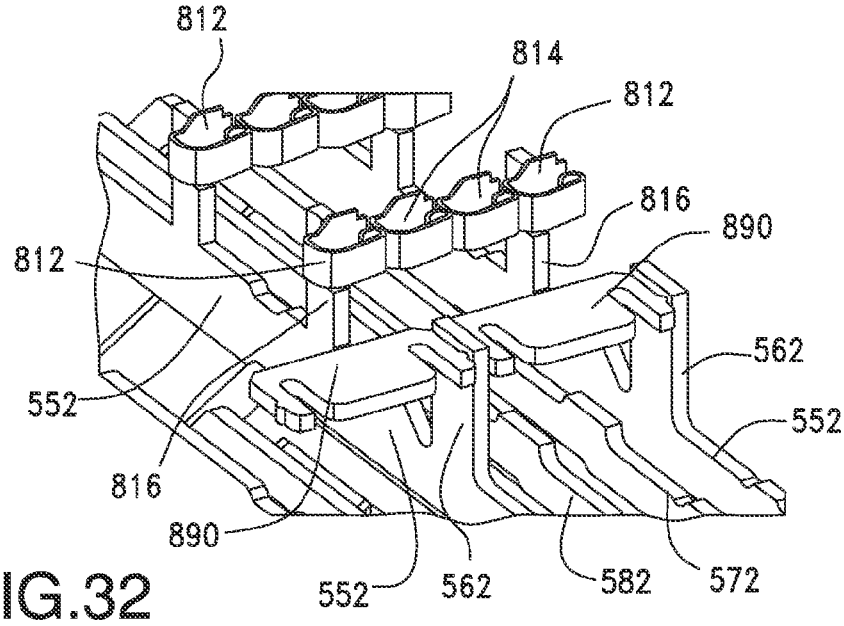
FIG. 32 is a perspective view similar to that of FIG. 30A but depicting only two ground and two signal wafers and with the insulation removed from the wafers for clarity.

As best seen in FIG. 32 due to the removal of the plastic insulation of wafers 850, 870, 880, the individual ground clips 812 secured within each ground wafer 850 conductively engage a tab 816 associated with each ground terminal 552, 554, 556, 558. However, the individual ground clips 814 secured within each signal wafer 870, 880 are spaced from the edge of the closest signal terminal by a sufficient distance (similar to distance 588 of FIG. 11) so as to avoid electrical interference and impedance affects on the signal terminals. The grounding clips may be formed of sheet metal or another resilient conductive material and, as depicted, are generally U-shaped or oval-shaped.

When the wafers 850, 870, 880 are assembled, the ground clips 812, 814 combine to serve the same purpose as pins 600, namely, to interconnect the adjacent ground terminals along the length thereof in order to reduce the electrical length between discontinuities along the ground terminals. Thus, as with the embodiment of FIGS. 29-32, grounding clips 812, 814 permit the ground terminals 552, 554, 556, 558 to have a maximum effective electrical length that is substantially shorter than the effective electrical length of the terminals.

Figure 33:
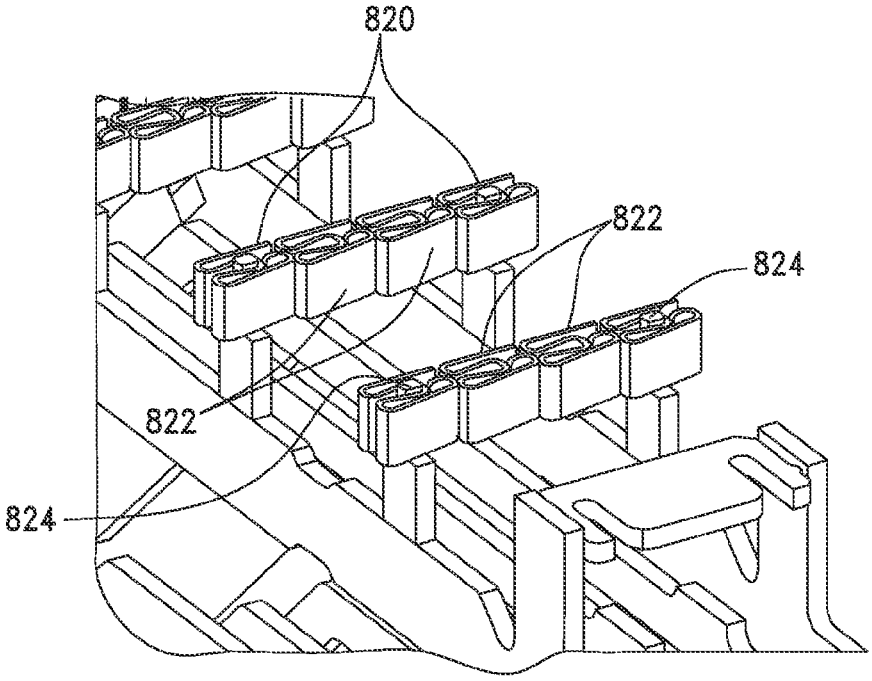
FIG. 33 is a perspective view similar to FIG. 32 but of an alternate embodiment of grounding clips.
Figure 34:
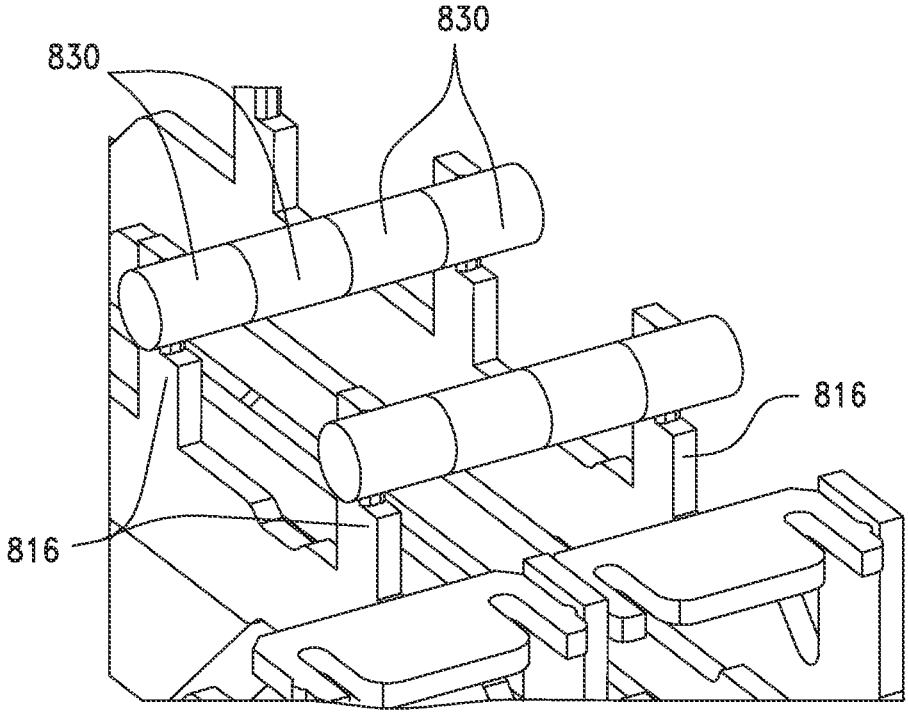
FIG. 34 is a perspective view similar to FIG. 32 but of another alternate embodiment of ground pins.

Referring to FIG. 33, another embodiment of individual ground clips is disclosed. As with ground clips 812, 814 discussed above, ground clips 820, 822 are identically shaped, resilient conductive members and may be formed of conductive sheet metal. Ground clips 820, 822 are similar in shape to ground clips 812, 814 except that they include an internal resilient, relatively small U-shaped section so that clips 820 may resiliently and conductively engage tabs 824 of the ground terminals.

In another embodiment, the resilient ground clips 812, 814 may be replaced by cylindrical posts 830 (FIG. 34) that are retained within each wafer 850, 870, 880. Upon assembling the wafers side-by-side, the posts 830 will combine to resemble pins 600. In other words, if desired, pins 600 may be formed of multiple components rather than utilizing a one-piece construction.

Figure 35:
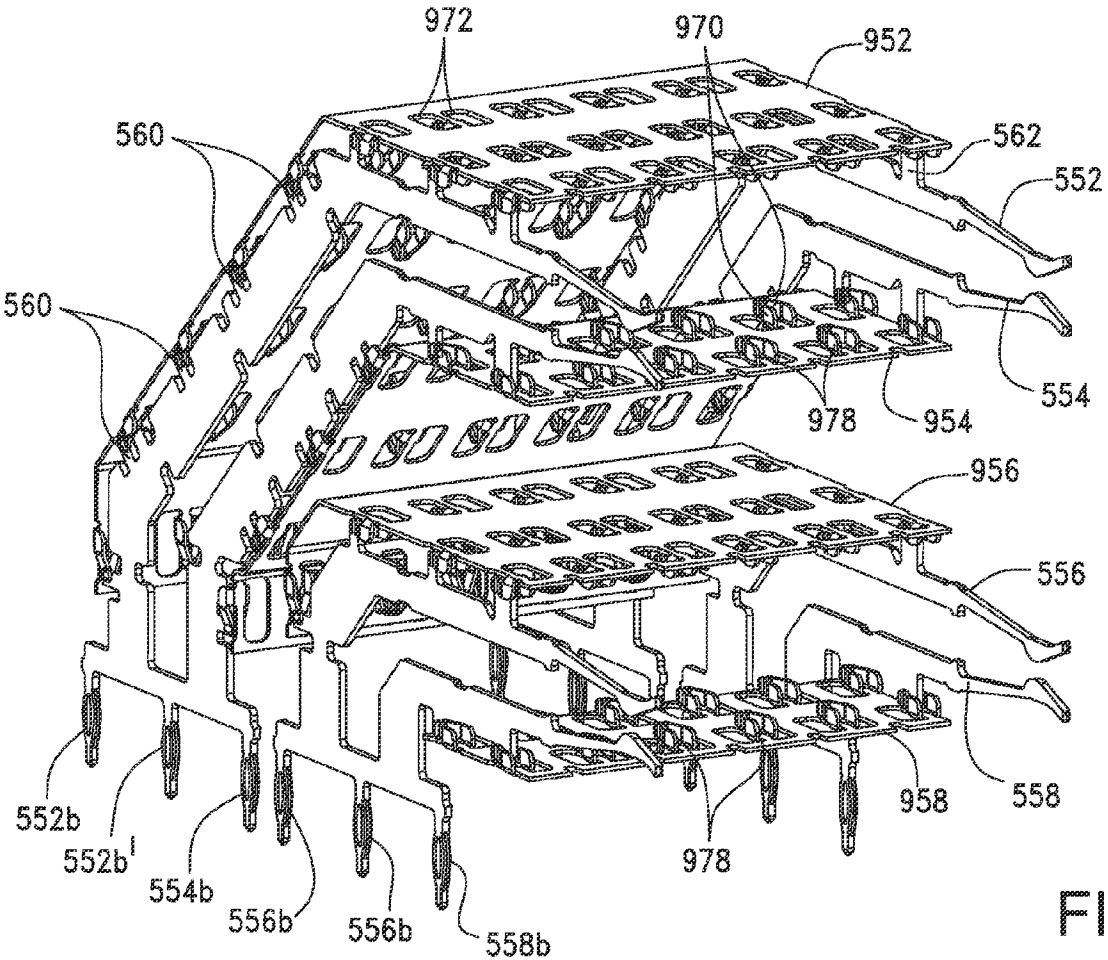
FIG. 35 is a front perspective view of an alternate embodiment of a ground terminal bridging structure with only a few ground terminals depicted for clarity.
Figure 36:
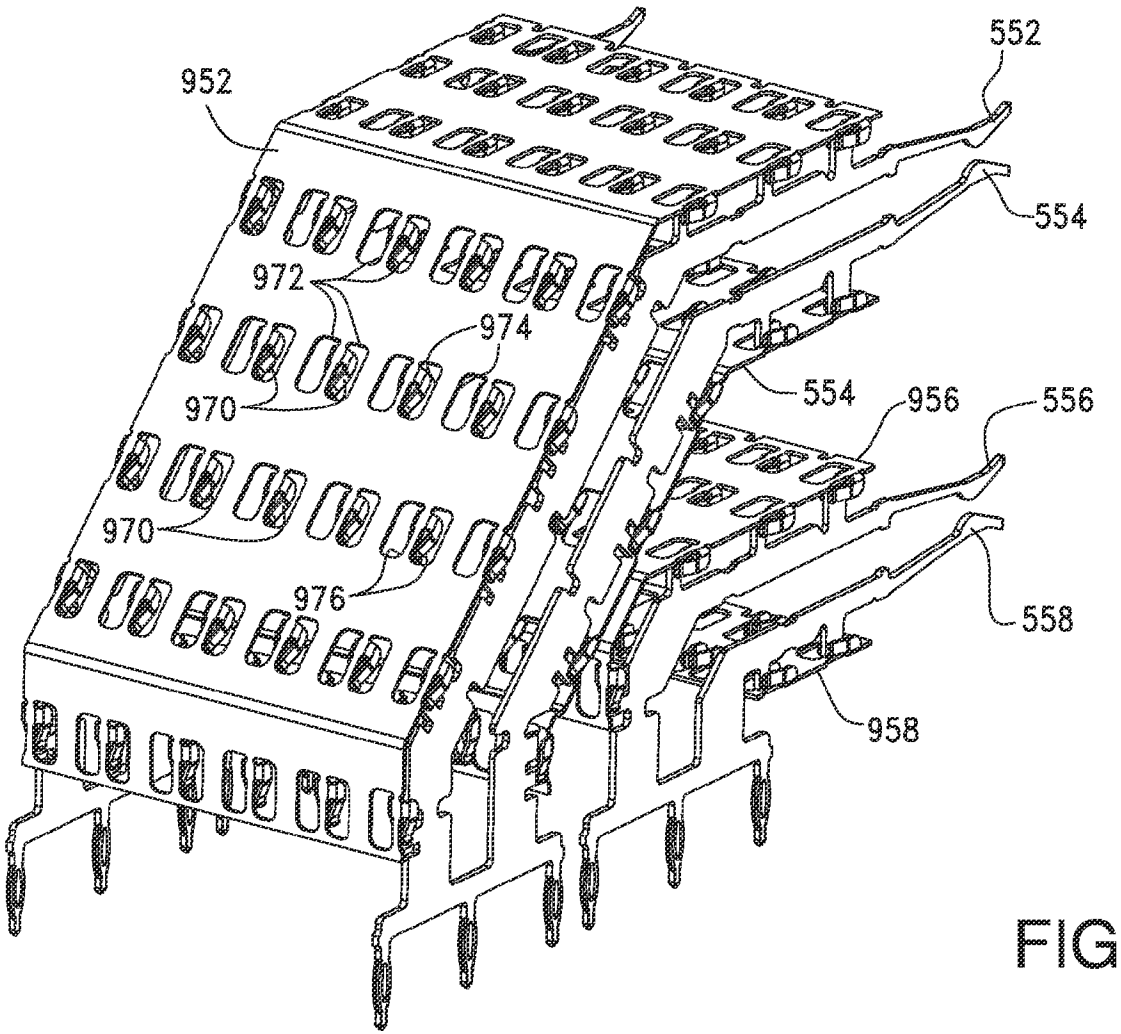
FIG. 36 is a rear perspective view of the ground bridging structure and ground terminals of FIG. 35.
Figure 36A:
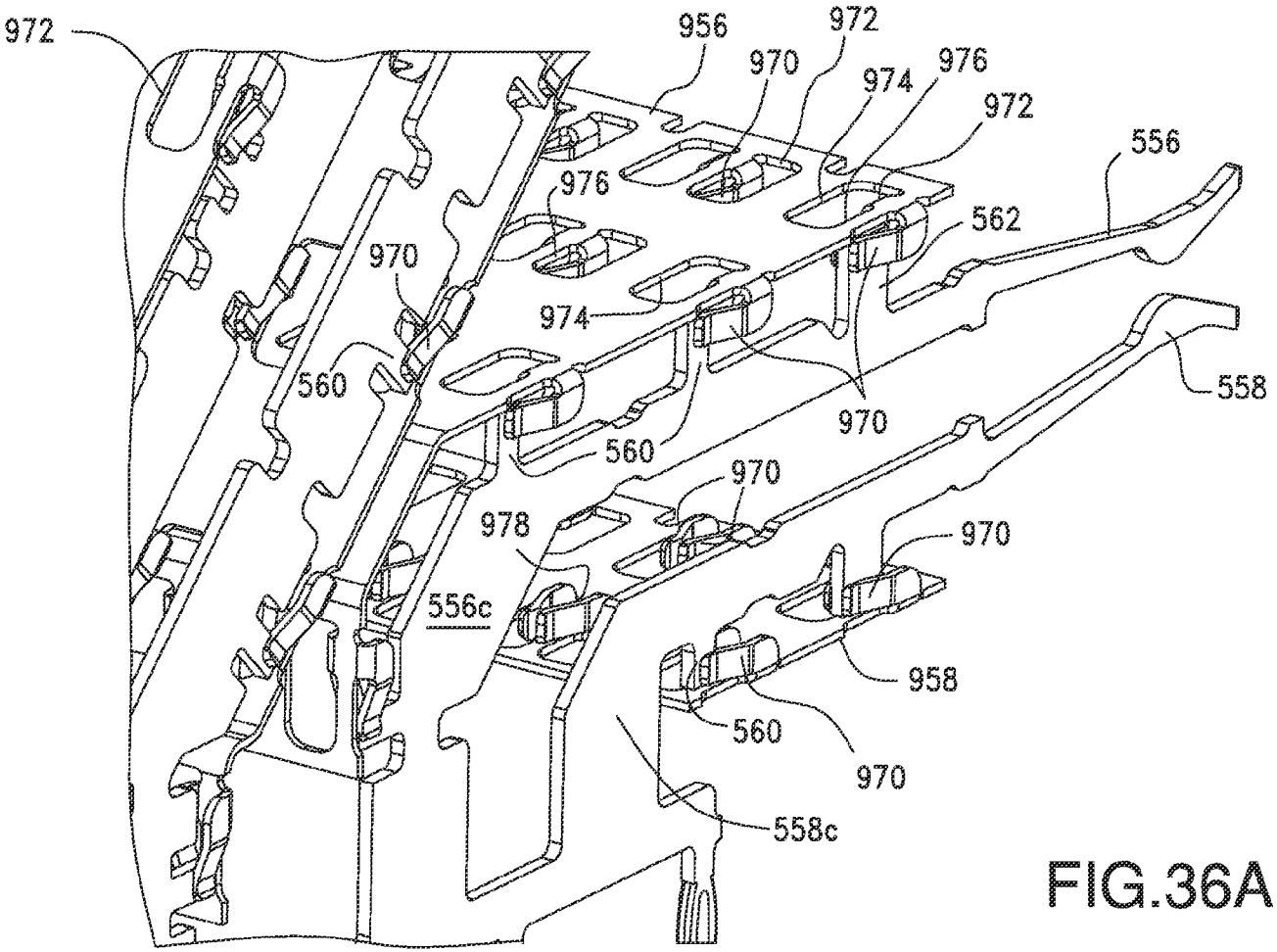
FIG. 36A is an enlarged perspective view of a portion of FIG. 36.

FIGS. 35-36A illustrate a subassembly of ground terminals that utilize an alternate embodiment of a structure for electrically bridging such terminals. The ground terminals are similar to those shown in FIG. 10 and like reference numbers are used with respect to like elements and the description of such elements is omitted. Comparing FIG. 35 to FIG. 10, it can be seen that all of signal terminals and all but a few of the ground terminals have been removed for clarity. More specifically, all of the terminals of FIG. 10 have been removed except for those on the outer ends of the terminal array. A plate-like bridging structure is associated with each row of ground terminals. An upper row of ground terminals 552 has a first plate-like bridging structure 952 associated therewith, a second row of ground terminals 554 has a second plate-like bridging structure 954 associated therewith, a third row of ground terminals 556 has a third plate-like bridging structure 956 associated therewith and a lower row of ground terminals 558 has a fourth plate-like bridging structure 958 associated therewith. Each of the three upper bridging structures 952, 954, 956 are shaped as bent plates formed with multiple, interconnected, generally planar segments while the fourth bridging structure 958 is generally planar.

Each bridging structure includes a plurality of pairs of spaced apart, opposed resilient spring arms 970 positioned in a three-dimensional array and aligned with fingers 560 of each ground terminal. Each arm 970 is formed by stamping and forming the sheet metal so as to create the downwardly depending resilient arms and creating a window 972 in the sheet metal. While not shown, each signal contact is generally aligned with one of the edges 974 of window 972 opposite the edge 976 from which the spring arm depends. Each arm 970 is shaped so as to taper inward towards its opposing arm in order to create an enlarged inlet 978 to facilitate insertion of finger 560 into engagement with each pair of arms. Upon insertion of finger 560, spring arms 970 deflect outward in a direction generally perpendicular to the plane of the body sections of the ground terminals.

Figure 37:
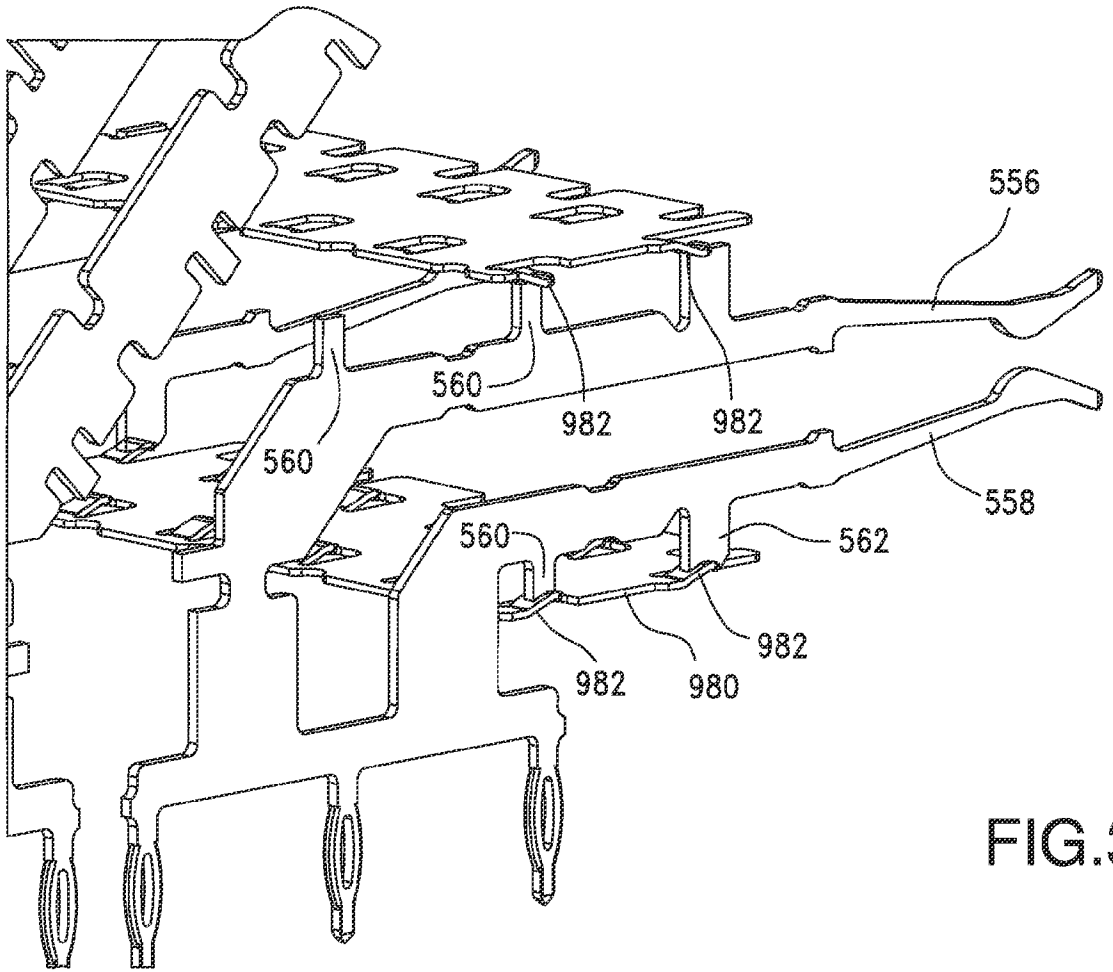
FIG. 37 is an enlarged perspective view similar to FIG. 36A but depicting an alternate embodiment of contact arms for the bridging structure.

FIG. 37 depicts an alternate embodiment of a plate-like bridging structure 980 in which each pair of spring arms 970 is replaced by a single spring arm 982 that is deflectable in a direction generally perpendicular to the plane of the segment of the bridging structure from which it depends. In other words, the single spring arms 982 are configured and positioned so as to be aligned with fingers 560 and deflect in the direction that each finger 560 extends away from its ground terminal.

As depicted, the bridging structures 952, 954, 956, 958, 980 are formed of sheet metal so as to have the desired electrical and mechanical characteristics. It should be noted that with respect to the embodiment depicted in FIGS. 35-37, fingers 560 were formed so as to be resilient and deflect to some extent upon engagement by pins 600. Since the spring arms 970, 982 of the plate-like bridging structures are resilient, it is not necessary for fingers 560 be resilient when used with the plate like bridging structures depicted herein.

It should be noted that, in general, the longest section of the ground path between discontinuities will tend to control the resultant resonant frequency. Therefore, an electrical path that has a number of closely spaced bridges to create a series of short electrical lengths between discontinuities while also having a longer section between discontinuities will have an effective electrical length determined by the longer section between discontinuities. Consequently, it is beneficial to ensure that the maximum or longest effective electrical length between discontinuities is below or less than a predetermined length.

When designing a high data rate connector, a desired operational frequency range of the connector is typically known. Once the designer has designed a connector (or obtained a pre-existing connector), the connector can be analyzed to determine a maximum effective electrical length between discontinuities along adjacent ground paths in which the connector will be used. While this length is primarily the electrical length of the ground terminals, other factors contribute to the effective electrical length including any distance along the circuit path outside of the connector prior to reaching a discontinuity as well as other factors that affect the characteristics of the conductors.

Based upon the maximum effective electrical length between discontinuities, an initial or unmodified resonant frequency can be determined. If the initial or unmodified resonant frequency is too low (which means that the operational range of the connector will overlap with the resonant frequency), a maximum desired effective electrical length is determined such that the resonant frequency for such effective length will be sufficiently above the desired operational frequency range of the connector. At that point, one or more conductive bridges, such as those incorporating the structures disclosed herein, may be used to interconnect adjacent ground members and reduce the effective electrical length between discontinuities to a length less than the maximum desired effective length and thus increase the resonant frequency of the ground structure of the connector. In the alternative, the maximum desired effective length could be determined (based upon a desired resonant frequency) prior to determining the maximum effective electrical length between discontinuities. It should be noted that analyzing the connector to determine the longest effective electrical length between discontinuities and the desired maximum electrical length can be performed either by simulation of the circuitry or by actual measurement if physical samples of the connector exist.

It has been determined that a stacked SFP type connector with ground terminals that have an effective electrical length of about less than 38 picoseconds is suitable for use with signaling frequencies of about 8.5 GHz, which should provide about a 17 Gbps connector per differential signal pair when using a non-return to zero (NRZ) signaling method.

Careful placement of the bridges may allow the effective electrical length of the ground terminals to be reduced to about 33 picoseconds, which may be suitable for signaling frequencies of about 10 GHz (and thus may be suitable for about 20 Gbps performance). If the bridges are configured to be even closer together physically, the effective electrical length can be reduced to about 26 picoseconds, which may be suitable for transmitting signals at about 13 GHz or 25 Gbps performance (assuming NRZ signaling methodology). As can be appreciated, therefore, spacing the bridges closer together (and thus increasing the number of bridges) will have the tendency to reduce the effective electrical length of the ground terminals and consequentially help make the connector more suitable for higher frequencies and higher data rates. The desired maximum effective electrical length will vary depending on the application and the frequencies being transmitted.

In an embodiment, the connector can be configured so as to reduce the effective electrical length of a plurality of ground terminals so as to shift the resonant frequency sufficiently, thereby providing a substantially resonance free connector up to the Nyquist frequency, which is one half the sampling frequency of a discrete signal processing system. For example, in a 10 Gbps system using NRZ signaling, the Nyquist frequency is about 5 GHz. In another embodiment, the maximum electrical length of a plurality of ground connectors may be configured based on three halves (3/2) the Nyquist frequency which, for a 10 Gbps system is about 7.5 GHz, for a 17 Gbps system is about 13 GHz and for a 25 Gbps system is about 19 GHz. If the maximum electrical length is such that the resonance frequency is shifted out of the 3/2 Nyquist frequency range, a substantial portion of the power transmitted, potentially more than 90 percent, will be below the resonant frequency and thus most of the transmitted power will not cause a resonance condition that might otherwise increase noise within the system.

It should be noted that the actual frequency rate and effective electrical lengths vary depending upon the materials used in the connector, as well as the type of signaling method used. The examples given above are for the NRZ method, which is a commonly used high data rate signaling method. As can be appreciated, however, in other embodiments two or more ground terminals may be coupled together with a bridge at a predetermined maximum electrical length so that the connector is effective in shifting the resonance frequency for some other desired signaling method. In addition, as is known, electrical length is based on the inductance and capacitance of the transmission line in addition to the physical length and will vary depending on geometry of the terminals and materials used to form the connector. Thus, similar connectors with the same basic exterior dimensions may not have the same effective electrical length due to construction differences.

It will be understood that there are numerous modifications of the illustrated embodiments described above which will be readily apparent to one skilled in the art, such as many variations and modifications of the resonance modifying connector assembly and/or its components, including combinations of features disclosed herein that are individually disclosed or claimed herein, explicitly including additional combinations of such features, or alternatively other types of signal and ground contacts. For example, bridging structures can be used with arrays of signal and ground terminals regardless of whether the terminals are positioned in wafers that are inserted into a housing or the terminals are inserted directly into a housing. In addition, if the signal terminals are configured as differential pairs, they may be broad-side or edge coupled. Also, there are many possible variations in the materials and configurations. For example, components that are formed of metal may be formed of plated plastic provided that the necessary mechanical and electrical characteristics of the components are maintained. These modifications and/or combinations fall within the art to which this invention relates and are intended to be within the scope of the claims, which follow. It is noted, as is conventional, the use of a singular element in a claim is intended to cover one or more of such an element.

The invention claimed is:

1. A method of providing an electrical connector with a ground terminal having an electrical length less than a predetermined value, comprising:

providing a housing;

positioning a first wafer, a second wafer and a third wafer in the housing, the first wafer including a first ground terminal defining a first electrical path, the second wafer including a signal terminal and the third wafer including a second ground terminal defining a second electrical path; and providing a bridge between the first and second ground terminals, the bridge shorting the first ground terminal to the second ground terminal so as to reduce an electrical length between impedance discontinuities along the first and second ground members to less than a desired effective electrical length.

2. The method of claim 1, wherein the providing of the bridge comprises inserting a pin through the first, second and third wafer so as to engage the first and second ground terminal at a predetermined location while extending transversely to but not contacting the signal terminal.

3. The method of claim 2, wherein each ground terminal has a finger and the inserting of the pin causes the pin to physically engage the respective fingers.

4. The method of claim 1, wherein the providing of the bridge comprises inserting two pins through the first, second and third wafer, each of the two pins electrically connected to the first and second ground terminals.

5. The method of claim 1, further comprising positioning a fourth wafer between the second wafer and the third wafer, the fourth wafer having a signal terminal, the two signal terminals for the second and fourth wafers being aligned side-by-side in a configuration intended to provide a differentially-coupled signal pair, the ground terminals being positioned on opposite sides of the two signal terminals.

6. The method of claim 5, wherein each of the ground and signal terminals includes a contact, the positioning of the wafers causing the contacts to be inserted into a first side of a card slot.

7. The method of claim 6, wherein each wafer has an additional terminal configured to operate in a manner similar to the other terminal in the wafer, wherein the positioning of the wafers in the housing causes contacts of the additional terminals to be inserted into a second side of the card slot.

8. The method of claim 7, the method further including the providing of a second bridge, the second bridge configured to electrically connect the additional ground terminals of the first and third wafer.

9. The method of claim 1, wherein each of the wafers includes a conductive clip, the clips in the first and third wafer connected to the respective ground terminals and the clip in the second wafer insulated from the signal terminal and wherein the positioning of the first, second and third wafers in the housing physically connects the clips in the first, second and third wafer together so as to provide the bridge.

10. The method of claim 9, the positioning of the first, second and third wafers causing the clips to deflect.

11. The method of claim 1, wherein the providing of the bridge comprises providing one clip that engages the ground terminals into the first and third wafers with a first and second spring finger, the clip extending transversely to the signal terminal.

12. The method of claim 11, wherein the clip includes a first spring finger and a second spring finger, the first and second spring finger configured to engage one of the ground terminals.

13. The method of claim 1, wherein the providing of the bridge comprises provides a plate-like bridged structure, the bridge structure having spring fingers that extend from therefrom, the spring fingers engaging the ground terminals.

14. The method of claim 13, wherein the bridge structure extends along a plane and the base further includes spring fingers that extend away from the plane, wherein the providing of the bridge causes the spring fingers to resiliently engage the ground terminals.

* * * * *